US009454092B2

(12) United States Patent
Yamazaki et al.

(10) Patent No.: US 9,454,092 B2
(45) Date of Patent: Sep. 27, 2016

(54) ELECTROPHOTOGRAPHIC PHOTORECEPTOR, ELECTROPHOTOGRAPHIC PHOTORECEPTOR CARTRIDGE, AND IMAGE FORMING APPARATUS

(71) Applicant: MITSUBISHI CHEMICAL CORPORATION, Chiyoda-ku (JP)

(72) Inventors: Daisuke Yamazaki, Kanagawa (JP); Aiko Harada, Kanagawa (JP); Kazutaka Ida, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 14/578,542

(22) Filed: Dec. 22, 2014

(65) Prior Publication Data

US 2015/0168855 A1 Jun. 18, 2015

Related U.S. Application Data

(63) Continuation of application No. PCT/JP2013/066848, filed on Jun. 19, 2013.

(30) Foreign Application Priority Data

| | | |
|---|---|---|
| Jun. 20, 2012 | (JP) | 2012-138967 |
| Jul. 2, 2012 | (JP) | 2012-148568 |
| Jul. 31, 2012 | (JP) | 2012-170116 |
| Mar. 22, 2013 | (JP) | 2013-060367 |

(51) Int. Cl.

| | |
|---|---|
| ***G03G 5/00*** | (2006.01) |
| ***G03G 5/14*** | (2006.01) |
| ***G03G 5/05*** | (2006.01) |

(52) U.S. Cl.
CPC *G03G 5/14* (2013.01); *G03G 5/05* (2013.01); *G03G 5/142* (2013.01)

(58) Field of Classification Search
CPC ..... G03G 5/142
USPC ..... 430/60, 64
See application file for complete search history.

(56) References Cited

U.S. PATENT DOCUMENTS

| | | | |
|---|---|---|---|
| 4,994,339 | A | 2/1991 | Kinoshita et al. |
| 5,104,757 | A | 4/1992 | Koyama et al. |
| 2007/0154825 | A1 | 7/2007 | Tamoto et al. |

FOREIGN PATENT DOCUMENTS

| | | |
|---|---|---|
| JP | 52-025638 | 2/1977 |
| JP | 58-045707 | 10/1983 |

(Continued)

OTHER PUBLICATIONS

International Search Report issued in PCT/JP2013/066848, dated Sep. 24, 2014.

*Primary Examiner* — Mark A Chapman
(74) *Attorney, Agent, or Firm* — Oblon, McClelland, Maier & Neustadt, L.L.P.

(57) ABSTRACT

An object of the invention is to provide an electrophotographic photoreceptor in which the adhesion of the photosensitive layer is highly satisfactorily maintained regardless of the magnitude of shrinkage, and both of excellent electrical properties and excellent image characteristics are achieved. The present invention relates to an electrophotographic photoreceptor comprising: a conductive support; and, provided thereon, at least an undercoat layer and a photosensitive layer, wherein the undercoat layer comprises a binder resin and the binder resin comprises a polyamide resin which has a degree of elastic deformation of 56.0% or higher.

24 Claims, 3 Drawing Sheets

(56) References Cited

FOREIGN PATENT DOCUMENTS

| | | |
|---|---|---|
| JP | 60-168157 | 8/1985 |
| JP | 63-271465 | 11/1988 |
| JP | 02-183265 | 7/1990 |
| JP | 2-242265 | 9/1990 |
| JP | 09-068821 | 3/1997 |
| JP | 10-115945 | 5/1998 |
| JP | 2000-075517 | 3/2000 |
| JP | 2002-040688 | 2/2002 |
| JP | 2006-208474 | 8/2006 |
| JP | 2007-79303 | 3/2007 |
| JP | 2009-237179 | 10/2009 |
| JP | 2010-049279 | 3/2010 |
| JP | 2011-197261 | 10/2011 |

ELECTROPHOTOGRAPHIC PHOTORECEPTOR, ELECTROPHOTOGRAPHIC PHOTORECEPTOR CARTRIDGE, AND IMAGE FORMING APPARATUS

TECHNICAL FIELD

The present invention relates to an electrophotographic photoreceptor, an electrophotographic photoreceptor cartridge, and an image forming apparatus. In particular, the invention relates to an electrophotographic photoreceptor, an electrophotographic photoreceptor cartridge, and an image forming apparatus, which are excellent in terms of the adhesion of the photosensitive layer and which has satisfactory electrical properties.

BACKGROUND ART

Electrophotography has recently come to be extensively used in and applied to electrostatic copiers, facsimile, laser beam printers, etc. owing to the advantages thereof including instantaneousness and the ability to give high-quality images. The electrophotographic photoreceptors used in these image forming apparatus mainly are so-called organic photoreceptors obtained by forming a photosensitive layer including a charge-generating agent, a charge-transporting agent, and a binder resin on a conductive support.

However, the electrophotographic photoreceptor obtained by directly coating a conductive support with a photosensitive layer has a possibility that since the conductive support is close to the photosensitive layer, charges might be injected into the photosensitive layer. There are hence cases where microscopic disappearance of surface charges or a microscopic decrease in the amount of surface charges occurs, resulting in image defects.

In addition, formation of a photosensitive layer having an even thickness is difficult because of the influence of the surface state of the conductive support. The resultant unevenness in the thickness of the photosensitive layer may cause image defects such as density unevenness and pinholes. Such images are formed especially in high-temperature and high-humidity atmospheres.

A technique for preventing such image defects is being employed in which an undercoat layer is disposed between the conductive support and a charge generation layer, for example, in order to prevent charge injection from the conductive support, to conceal surface defects of the conductive support, and to improve adhesion between the photosensitive layer and the support. For the undercoat layer, an organic-solvent-soluble polyamide resin or the like is used (see, for example, patent documents 1 to 9).

Meanwhile, electrophotographic photoreceptors having a single undercoat layer constituted of a conventional polyamide resin or the like undergo considerable accumulation of residual potential, and there are cases where a considerable decrease in sensitivity, image fogging, and the like come to occur with the lapse of time.

For the purposes of mitigating the residual-potential accumulation due to the influence of the conductive support and preventing image defects, a technique is being employed in which an undercoat layer constituted of an organic-solvent-soluble polyamide resin which contains fine particles of a metal oxide is disposed on the conductive support (see, for example, patent documents 4 to 9).

Furthermore, a technique in which an undercoat layer or an interlayer is laminated on a conductive support and a technique in which an N-alkoxy(methoxy) methylated nylon is incorporated into an undercoat layer or interlayer are being employed, and are regarded as effective means for inhibiting charge injection from the conductive support and enhancing the effect of inhibiting background soils (see, for example, patent documents 8 and 9).

Meanwhile, electrophotographic photoreceptors employing an organic photoconductive substance have various advantages. However, these electrophotographic photoreceptors do not satisfy all the properties which are required of an electrophotographic photoreceptor. In particular, when such an electrophotographic photoreceptor is repeatedly used in a copier or a printer, the photosensitive layer deteriorates gradually. There is hence a desire for an electrophotographic photoreceptor which suffers little damage by repeated use, has high sensitivity and a low residual potential, and retains stable electrical properties.

These properties depend considerably on the charge generation substance, charge transport substance, additives, and binder resin.

Phthalocyanine pigments and azo pigments are mainly used as the charge generation substance, since the charge generation substance must have sensitivity to the light source for light input. Although various kinds of substances are known as the charge transport substance, amine compounds among these show an exceedingly low residual potential and are hence being utilized extensively (see, for example, patent documents 10 and 11).

As described above, a large number of photoreceptor materials including charge generation substances, charge transport substances, and binder resins are known. However, even when materials known to have high performance are selected from these at random and used in combination, this does not make it possible to provide an electrophotographic photoreceptor which has excellent electrophotographic photoreceptor properties and which, when used in an image forming apparatus, actually gives desired images of high quality.

Especially in recent years, an improvement in wear resistance is desired. One means for meeting the desire is a technique in which a binder resin having excellent wear resistance is used in a charge transport layer and the content of the charge transport substance is reduced to thereby minimize the decrease in the performance of the binder resin.

PRIOR-ART DOCUMENTS

Patent Documents

Patent Document 1: JP-B-58-45707
Patent Document 2: JP-A-60-168157
Patent Document 3: JP-A-2-183265
Patent Document 4: JP-A-2-242265
Patent Document 5: JP-A-2006-208474
Patent Document 6: JP-A-2009-237179
Patent Document 7: JP-A-2011-197261
Patent Document 8: JP-A-2010-49279
Patent Document 9: JP-A-9-68821
Patent Document 10: JP-A-2000-075517
Patent Document 11: JP-A-2002-040688

SUMMARY OF THE INVENTION

Problems that the Invention is to Solve

However, investigations made by the present inventors have revealed that in the case where a binder resin having excellent wear resistance is used, the photosensitive layer undergoes enhanced shrinkage to have increased internal stress and the photosensitive layer hence comes to have impaired adhesion, resulting in separation between the photosensitive layer and the undercoat layer or between the undercoat layer and the support. Phenomena were simultaneously observed in which the deterioration in adhesion resulted in a considerable deterioration in electrical properties and in which replacing the binder resin of the undercoat layer with other binder resins for the purpose of adhesion improvement resulted in a deterioration in electrical property.

The present invention has been achieved in view of the problems described above. An object of the invention is to provide an electrophotographic photoreceptor in which the adhesion of the photosensitive layer is highly satisfactorily maintained regardless of the magnitude of shrinkage and which combines satisfactory electrical properties and image characteristics. Another object is to provide a process cartridge and an image forming apparatus which employ the electrophotographic photoreceptor.

Means for Solving the Problems

The inventors have found that an electrophotographic photoreceptor including at least an undercoat layer and a photosensitive layer which have been provided over a conductive support can have improved adhesion in cases when the binder resin contained in the undercoat layer includes a polyamide resin which has a degree of elastic deformation within a specific range and which has a specific structure. Namely, essential points of the invention reside in the following <1> to <15>.

<1>

An electrophotographic photoreceptor comprising: a conductive support; and, provided thereon, at least an undercoat layer and a photosensitive layer, wherein the undercoat layer comprises a binder resin and the binder resin comprises a polyamide resin which has a degree of elastic deformation, as determined on the basis of the following measuring method, of 56.0% or higher:

[Measuring method] The polyamide resin molded into a film having a thickness of 10 μm or larger, is examined using a Vickers indenter in an atmosphere having a temperature of 25° C. and a relative humidity of 50% under the conditions of a maximum indentation load of 5 mN, a load-increasing period of 10 seconds and a load-removing period of 10 seconds to obtain a maximum indentation depth, and the value at the maximum indentation depth is taken as the degree of elastic deformation.

<2>

The electrophotographic photoreceptor according to the <1> above, wherein the polyamide resin contains a polyether structure.

<3>

The electrophotographic photoreceptor according to the <1> or <2> above, wherein the content of the polyamide resin is 25 parts by mass or higher per 100 parts by mass of the binder resin.

<4>

The electrophotographic photoreceptor according to any one of the <1> to <3> above, wherein the photosensitive layer contains a polyarylate resin.

<5>

An electrophotographic photoreceptor comprising: a conductive support; and, provided thereon, at least an undercoat layer and a photosensitive layer, which have been laminated in this order from the conductive-support side, wherein the undercoat layer comprises a polyamide resin which contains: at least one of a linear dicarboxylic acid component and a branched dicarboxylic acid component; at least one of a lactam component and an aminocarboxylic acid component; and a polyether component.

<6>

The electrophotographic photoreceptor according to the <5> above, wherein the polyamide resin is a block copolymerized polyamide resin comprising: a polyamide block which comprises the at least one of a linear dicarboxylic acid component and branched dicarboxylic acid component and the at least one of a lactam component and aminocarboxylic acid component; and a polyether block which comprises the polyether component.

<7>

The electrophotographic photoreceptor according to the <6> above, wherein the block copolymerized polyamide resin is represented by the following general formula [1]:

[Chem. 1]

$$-[HS\text{-}SS]_n- \quad [1]$$

(In formula [1], HS represents a hard segment, which is a polymer unit comprising at least one kind of polyamide block that comprises at least one of a lactam component and an aminocarboxylic acid component and at least one of a linear dicarboxylic acid component and a branched dicarboxylic acid component; and SS represents a soft segment, which is a polymer unit comprising a polyether block that comprises at least one kind of polyether component.)

<8>

The electrophotographic photoreceptor according to the <7> above, wherein the HS and SS in the block copolymerized polyamide resin represented by general formula [1] have been bonded to each other by an ester bond.

<9>

The electrophotographic photoreceptor according to any one of the <6> to <8> above, wherein the polyether block includes polytetramethylene ether glycol or polypropylene ether glycol.

<10>

The electrophotographic photoreceptor according to any one of the <6> to <9> above, wherein the content of the polyether block in the undercoat layer is 4% by mass or higher.

<11>

The electrophotographic photoreceptor according to any one of the <6> to <10> above, wherein the polyamide block is obtained by polymerizing at least one of a lactam having a single structure and an aminocarboxylic acid having a single structure.

<12>

The electrophotographic photoreceptor according to any one of the <6> to <11> above, wherein the block copolymerized polyamide resin contains no dimer acid component.

<13>

The electrophotographic photoreceptor according to any one of the <6> to <12> above, wherein the block copolymerized polyamide resin contains no diamine component.

<14>

An electrophotographic photoreceptor cartridge which comprises: the electrophotographic photoreceptor according to any one of the <1> to <13> above; and at least one part selected from the group consisting of a charging part for charging the electrophotographic photoreceptor, an exposure part for exposing the charged electrophotographic photoreceptor to form an electrostatic latent image, a development part for developing the electrostatic latent image formed on the electrophotographic photoreceptor, and a cleaning part for cleaning the surface of the electrophotographic photoreceptor.

<15>

An image forming apparatus which comprises: the electrophotographic photoreceptor according to any one of the <1> to <13> above; a charging part for charging the electrophotographic photoreceptor; an exposure part for exposing the charged electrophotographic photoreceptor to form an electrostatic latent image; a development part for developing the electrostatic latent image formed on the electrophotographic photoreceptor; and a cleaning part for cleaning the surface of the electrophotographic photoreceptor.

Effects of the Invention

The electrophotographic photoreceptors of the invention can have satisfactory electrical properties and image characteristics and can simultaneously have satisfactory photosensitive-layer adhesion, since the undercoat layers include a binder resin including a specific polyamide resin or includes a polyamide resin containing specific components. It is possible to provide an electrophotographic process cartridge equipped with either of the electrophotographic photoreceptors and an image forming apparatus equipped with either of the electrophotographic photoreceptors.

MODES FOR CARRYING OUT THE INVENTION

Figure 1:
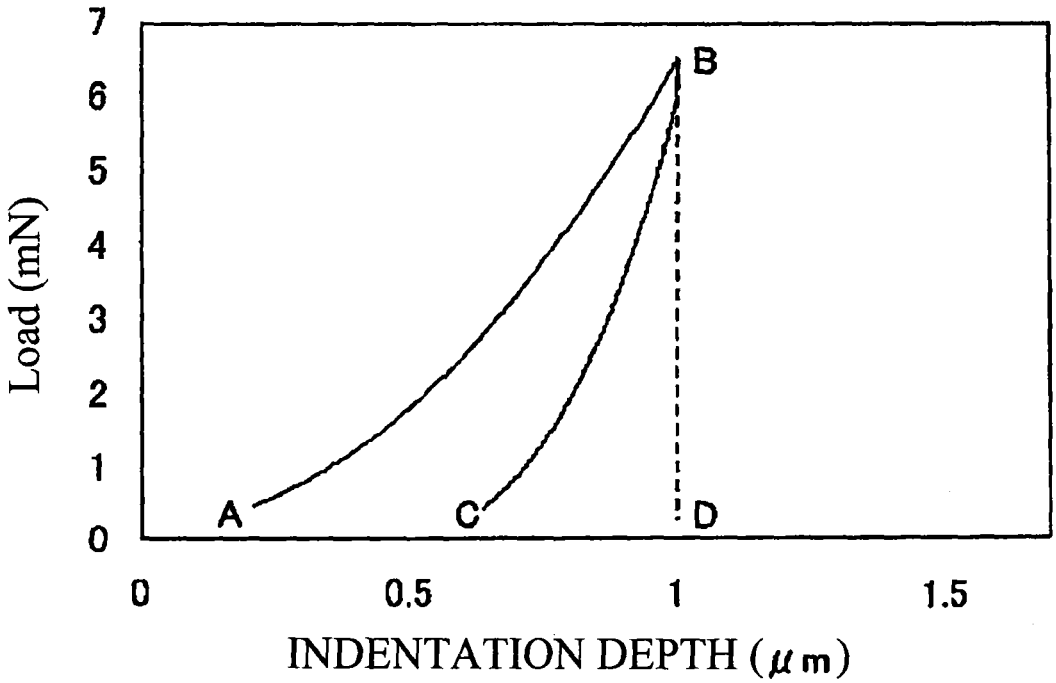
FIG. 1, is a curve which shows a relationship between indentation depth and load in a measurement of the degree of elastic deformation of a polyamide resin.

Embodiments of the invention will be explained below in detail, but the invention should not be construed as being limited to the following explanation and can be suitably modified without departing from the spirit of the invention. In this description, "% by weight", "parts by weight", and "weight ratio" have the same meanings as "% by mass", "parts by mass", and "mass ratio", respectively.

One of the electrophotographic photoreceptors according to the invention is characterized in that this electrophotographic photoreceptor has at least an undercoat layer and a photosensitive layer over a conductive support, and that the undercoat layer includes a binder resin and the binder resin includes a polyamide resin having a degree of elastic deformation of 56.0% or higher.

[Electrophotographic Photoreceptors]

The electrophotographic photoreceptors (hereinafter often referred to simply as "photoreceptors") of the invention are described below in detail.

<Conductive Support>

Mainly used as the conductive support (hereinafter often referred to simply as "support") for use in the photoreceptors is, for example, a metallic material such as aluminum, an aluminum alloy, stainless steel, copper, or nickel, a resinous material to which electrical conductivity has been imparted by adding a conductive powder, e.g., a metal, carbon, or tin oxide powder, or a resin, glass, paper, or the like, the surface of which has been coated with a conductive material, e.g., aluminum, nickel, or ITO (indium oxide/tin oxide), by vapor deposition or coating fluid application. With respect to form, the conductive support may be in the form of a drum, sheet, belt, or the like.

Use may be made of a conductive support which is made of a metallic material and which has been coated with a conductive material having an appropriate resistance value for the purposes of controlling conductivity, surface properties, etc. and of covering defects.

In the case where a metallic material such as an aluminum alloy is used as a conductive support, this material may be used after an anodized coating film is formed thereon. In the case where an anodized coating film has been formed, it is desirable to subject the material to a pore-filling treatment by a known method.

The anodized coating film is formed, for example, by anodizing the material in an acidic bath containing chromic acid, sulfuric acid, oxalic acid, boric acid, a sulfamic acid, or the like. However, anodization in sulfuric acid gives more satisfactory results.

In the case of anodization in sulfuric acid, it is preferred to set conditions to the following ranges: a sulfuric acid concentration of 100-300 g/L, a dissolved-aluminum concentration of 2-15 g/L, a liquid temperature of 15-30° C., an electrolytic voltage of 10-20 V, and a current density of 0.5-2 $A/dm^2$. However, the conditions are not limited to those shown above.

It is preferable that the anodized coating film thus formed should be subjected to a pore-filling treatment. Although the pore-filling treatment may be conducted by an ordinary method, it is preferred to subject the anodized coating film to, for example, a low-temperature pore-filling treatment in which the anodized coating film is immersed in an aqueous solution containing nickel fluoride as a main component or a high-temperature pore-filling treatment in which the anodized coating film is immersed in an aqueous solution containing nickel acetate as a main component.

The concentration of the aqueous nickel fluoride solution to be used in the case of low-temperature pore-filling treatment can be suitably selected. However, in the case where the solution having a concentration in the range of 3-6 g/L is used, more preferred results are obtained.

From the standpoint of enabling the pore-filling treatment to proceed smoothly, it is desirable to conduct the treatment at a treatment temperature of 25-40° C., preferably 30-35° C., while regulating the pH of the aqueous nickel fluoride solution to a value in the range of 4.5-6.5, preferably 5.5-6.0.

As a pH regulator, use can be made of oxalic acid, boric acid, formic acid, acetic acid, sodium hydroxide, sodium acetate, ammonia water, or the like. With respect to treatment period, it is preferred to conduct the treatment for a period in the range of 1-3 minutes per μm of the thickness of the coating film. In order to further improve the coating film properties, cobalt fluoride, cobalt acetate, nickel sulfate, a surfactant, or the like may be added beforehand to the aqueous nickel fluoride solution. Subsequently, the support is washed with water and dried to complete the low-temperature pore-filling treatment.

In the case of the high-temperature pore-filling treatment, use can be made of an aqueous solution of a metal salt such as nickel acetate, cobalt acetate, lead acetate, nickel cobalt acetate, or barium nitrate, as a pore-filling agent. However, it is especially preferred to use nickel acetate.

In the case of using an aqueous nickel acetate solution, it is preferred to use the solution having a concentration in the range of 5-20 g/L. The treatment temperature may be 80-100° C., and is preferably 90-98° C. It is preferred to conduct the treatment while regulating the pH of the aqueous nickel acetate solution to a value in the range of 5.0-6.0.

Here, ammonia water, sodium acetate, or the like can be used as a pH regulator. It is preferred to conduct the treatment for a period of 10 minutes or longer, preferably 20 minutes or longer. In this case also, sodium acetate, an organic carboxylic acid, an anionic or nonionic surfactant, or the like may be added to the aqueous nickel acetate solution in order to improve the coasting film properties.

Subsequently, the support is washed with water and dried to complete the high-temperature pore-filling treatment. In case where the average film thickness is too large, it is necessary to use severe pore-filling conditions including an increased concentration of the pore-filling liquid, an elevated temperature, and a prolonged treatment period. Consequently, not only impaired production efficiency results, but also the coating film surface is prone to have surface defects such as stains, soils, or powdering. From such standpoints, it is preferred to form an anodized coating film so that the average thickness thereof is usually 20 μm or less, in particular, 7 μm or less.

The surface of the support may be smooth, or may have been roughened by using a special machining method or by performing a grinding treatment. Alternatively, use may be made of a support having a roughened surface obtained by incorporating particles with an appropriate particle diameter into the material for constituting the support. Furthermore, a drawn pipe can be used as such without subjecting the pipe to machining, for the purpose of cost reduction. Especially in the case of using an aluminum support which has been obtained by drawing, impact drawing, squeezing, or the like and which has not undergone machining, it is preferred to conduct processing since adherent substances present on the surface, such as soils and foreign matter, small scratches, and the like are eliminated thereby and an even and clean support is obtained.

<Undercoat Layer>

It is preferred to dispose an undercoat layer between the conductive support and the photosensitive layer which will be described later. As the undercoat layer, use may be made, for example, of a resin or a resin in which particles of a metal oxide or the like have been dispersed. The undercoat layer further includes a binder resin. These materials may be used alone, or some resins and particles of a metal oxide or the like may be simultaneously used in combination. A conductive layer including both particles of, for example, a metal oxide and a binder resin and an interlayer including a binder resin may be laminated to constitute an undercoat layer.

Examples of the metal oxide particles for use in the undercoat layer include particles of a metal oxide containing one metallic element, such as titanium oxide, aluminum oxide, silicon oxide, zirconium oxide, zinc oxide, or iron oxide, and particles of a metal oxide containing a plurality of metallic elements, such as calcium titanate, strontium titanate, or barium titanate. Particles of one kind selected from these may be used alone, or particles of two or more kinds may be mixed together and used. Preferred of those particulate metals are titanium oxide and aluminum oxide. Especially preferred is titanium oxide.

The titanium oxide particles may be ones, the surface of which has been treated with an inorganic substance such as tin oxide, aluminum oxide, antimony oxide, zirconium oxide, or silicon oxide or with an organic substance such as stearic acid, a polyol, or a silicone.

With respect to the crystal form of the titanium oxide particles, any of rutile, anatase, brookite, and amorphous ones is usable. Furthermore, the titanium oxide particles may include particles in a plurality of crystal states.

Metal oxide particles having various particle diameters can be utilized. However, from the standpoints of properties and the stability of the fluid, the metal oxide particles to be used have an average primary-particle diameter of preferably 10-100 nm, especially preferably 10-50 nm. The average primary-particle diameter can be obtained from a TEM (transmission electron microscope) photograph, etc.

The proportion of the metal oxide particles to be added to the binder resin to be used for the undercoat layer can be selected at will. From the standpoint of the stability and applicability of the dispersion, however, it is usually preferred to use the metal oxide particles in an amount in the range of 10-500% by mass based on the binder resin.

<Polyamide Resin A>

A polyamide resin having a degree of elastic deformation of 56.0% or higher is contained as a binder resin in an undercoat layer according to the invention. The degree of elastic deformation will be described later. A polyamide resin having a degree of elastic deformation of 56.0% or higher can be obtained by using a polyamide component as a hard segment and introducing a soft segment thereinto to thereby produce a copolymerized polyamide resin.

Resins which may be included in the binder resin, besides the polyamide resin, will be described later.

It is thought that the crystalline regions of a polyamide resin are configured of hard segments and introduction of soft segments thereinto increases the amount of amorphous regions present between the spherulites, resulting in an increase in the degree of elastic deformation.

Examples of the soft segment include an aliphatic polyester component or aliphatic polyether which is a soft component that shows entropy elasticity. It is especially preferable that the polyamide resin should contain a polyether structure such as an aliphatic polyether, from the standpoints of solubility in solvents and adhesion.

Examples of the aliphatic polyester include ones obtained from an aliphatic diol, such as ethylene glycol, propylene glycol, 1,4-butanediol, 1,6-hexanediol, neopentyl glycol, or 1,4-bis(hydroxymethyl)cyclohexane, and a dicarboxylic acid and polycondensates of lactone compounds, such as poly(ϵ-caprolactone).

Examples of the aliphatic polyether include polyether glycols such as polyethylene glycol, polypropylene glycol, and polytetramethylene glycol.

Alcohol-soluble copolymerized polyamide resins, modified polyamide resins, and the like are preferred of polyamide resins, since these polyamide resins show satisfactory dispersibility and applicability. Especially preferred, from the standpoint of satisfactorily maintaining adhesion, is a polyamide resin which, when dissolved in a methanol/toluene=1/1 (by weight) mixed solvent in a solid concentration of 5% by weight, gives a solution that has a viscosity of 8.0-15.0 cP. From the standpoint of applicability, the viscosity of the solution is more preferably 8.1 cP or higher, especially preferably 8.2 cP or higher. Also from the standpoint of applicability, the viscosity thereof is more preferably 13.0 cP or less, especially preferably 11.0 cP or less. In case where a polyamide resin which is too high in the solution viscosity is used, there is a possibility that the coating fluid for undercoat layer formation might have reduced stability to give a coating film having impaired evenness, resulting in impaired adhesion. In case where the solution has too low a viscosity, the coating fluid for undercoat layer formation has too low a viscosity and only photoreceptors in which the undercoat layer thickness is too small can be produced. There is hence a possibility that the effect of enhancing adhesion between the undercoat layer and any adjoining layer or the support might not be obtained.

In the undercoat layer, the proportion of the polyamide resin having a degree of elastic deformation of 56.0% or higher is as follows. The lower limit of the proportion thereof in the whole undercoat layer is usually 1% by mass or higher, more preferably 10% by mass or higher, especially preferably 25% by mass or higher. This is because in case where the proportion of the polyamide resin having a degree of elastic deformation, which will be described later, of 56.0% or higher is too small, the effect of improving adhesion which will be described later is not effectively obtained. Although there is no particular upper limit, the proportion of the resin in the whole undercoat layer is usually 100% by mass or less, preferably 90% by mass or less, more preferably 80% by mass or less, from the standpoint of applicability.

From the standpoint of adhesion, the proportion of the polyamide resin having a degree of elastic deformation of 56.0% or higher, per 100 parts by weight of the whole binder resin, is preferably 5 parts by weight or higher, more preferably 25 parts by weight or higher, even more preferably 50 parts by mass or higher, especially preferably 100 parts by mass.

<Degree of Elastic Deformation and Universal Hardness>

The coating film of the polyamide resin to be contained in an undercoat layer according to the invention has a degree of elastic deformation of 56.0% or higher, more preferably 60.0% or higher, especially preferably 65.0% or higher. By regulating the degree of elastic deformation thereof so as to be within that range, adhesion between the photosensitive layer and the conductive support can be remarkably improved. Although there is no particular upper limit thereon, the degree of elastic deformation of the resin is usually 100% or less, preferably 90.0% or less, more preferably 80.0% or less, from the standpoint of ease of production. The reasons therefor, although unclear, are explained below.

When producing an electrophotographic photoreceptor by a known production process, a drying step is conducted. It is, however, thought that after the photosensitive layer has undergone the drying step and has shrunk, a force which pulls the undercoat layer up from the support side toward the surface side is being exerted. This stress exerting on the undercoat layer and the boundaries thereof is relieved by incising the photosensitive layer in a peeling test.

It is thought that in case where the resin constituting the undercoat layer has a low degree of elastic deformation, this undercoat layer is less apt to deform into the state of having little strain and, hence, the strain of the undercoat layer which generated due to the shrinkage cannot be relaxed and the interface between the undercoat layer and the photosensitive layer comes into the state of being easy to break.

Meanwhile, it is thought that in the case where a resin having a high degree of elastic deformation is incorporated into an undercoat layer, this undercoat layer is apt to deform into the state of having little strain and hence has enhanced resistance to separation. Since problems concerning adhesion failures which are encountered in practical use are thought to result from scratches, it is thought that the incorporation of a resin having a high degree of elastic deformation into the undercoat layer is effective not only for peeling tests but also practically.

The undercoat layer has a universal hardness of usually 55 $N/mm^2$ or less, more preferably 50 $N/mm^2$ or less. Although there is no particular lower limit thereon, the universal hardness of the undercoat layer is usually 1 $N/mm^2$ or higher, preferably 5 $N/mm^2$ or higher, more preferably 10 $N/mm^2$ or higher, from the standpoint of ease of production.

Reasons for the preference of that range include the following phenomenon.

During a process of electrophotography which means the stage of photosensitization (the state in which printing is being conducted), a force which presses the photosensitive layer toward the support side is exerted by the cleaning blade or the like, although the cause thereof is unclear. Although there are cases where the photosensitive layer contains pigment particles or the like, it is thought that in cases when the universal hardness of the undercoat layer is a value not higher than the upper limit, the pigment particles in the photosensitive layer are easily forced into the undercoat layer by the pressing force. It is thought that an anchoring effect is thereby obtained to improve adhesion.

An undercoat layer can be made to have a universal hardness of 55 $N/mm^2$ or less, for example, by incorporating into the undercoat layer a polyamide resin having a degree of elastic deformation of 55.0% or higher. In another technique, for example, the resin used for forming an undercoat layer contains soft segments and the universal hardness decreases as the content thereof increases. Furthermore, it is thought that in the case where the resin used for forming an undercoat layer has a Tg (glass transition point) of around room temperature or lower, this undercoat layer also has a reduced universal hardness. Moreover, as the amount of a metal oxide contained in an undercoat layer increases, the universal hardness decreases.

As shown above, a universal hardness of 55 $N/mm^2$ or less can be attained by using various methods or by using these methods in combination.

The values of the degree of elastic deformation and universal hardness used in the invention were measured using a microhardness meter (FISCHERSCOPE HM2000, manufactured by Fischer) in an atmosphere having a temperature of 25° C. and a relative humidity of 50%.

The polyamide resin in the case of determining the degree of elastic deformation or the undercoat layer in the case of determining universal hardness is formed on a film having a thickness of 10 μm or larger to obtain a test specimen. For the measurements, use is made of a Vickers square-based diamond pyramid indenter in which the angle between nonadjacent faces is 136°. The measurements are conducted respectively under the following set conditions, and the load being imposed on the Vickers indenter and the indentation depth under the load are continuously read and plotted as Y-axis and X-axis, respectively, thereby acquiring a profile such as that shown in FIG. 1.

(Conditions for Examining Polyamide Resin Coating Film)
Maximum indentation load, 5 mN
Load-increasing period, 10 sec
Load-removing period, 10 sec
(Conditions for Examining Undercoat Layer)
Maximum indentation load, 0.2 mN
Load-increasing period, 10 sec
Load-removing period, 10 sec The degree of elastic deformation in the invention is the value defined by the following equation and calculated from the results obtained by the measurement, and is the proportion of the amount of the work which the film performs by means of the elasticity thereof during the load removal to the total amount of the work required for the indentation.

$$\text{Degree of elastic deformation (\%)}=(We/Wt)\times 100$$

In the equation, Wt represents the total amount of work (nJ) and is indicated by the area surrounded by A-B-D-A in FIG. 1; and We represents the amount of the work made by elastic deformation (nJ) and is indicated by the area surrounded by C-B-D-C in FIG. 1.

The higher the degree of elastic deformation, the less the deformation caused by load remains. The case where the degree of elastic deformation is 100% means that the deformation does not remain at all.

The polyamide resin coating film to be used for determining the degree of elastic deformation in the invention can be, for example, a coating film obtained by dissolving the polyamide resin in a solvent therefor and applying the solution to a strong and flat support, e.g., a glass plate, using an applicator or the like so as to result in an even film thickness not less than 10 μm.

In the invention, the universal hardness of the undercoat layer is determined from the value obtained when the indenter was forced into the test specimen until the indentation load became 0.2 mN, among the results obtained by the measurement, and is expressed in terms of the value defined by the following equation from the indentation depth measured under the load.

$$\text{Universal hardness}(N/\text{mm}^2)=[\text{test load }(N)]/[\text{surface area}(\text{mm}^2)\text{ of the Vickers indenter under the test load}]$$

When determining the universal hardness of an undercoat layer, use can be made, for example, of a method in which the photosensitive layer of the photoreceptor drum is removed with a solvent or another means to expose the undercoat layer as an outermost layer.

<Glass Transition Temperature (Tg)>

The glass transition temperature (Tg) of the polyamide resin can be determined by examining the resin with a differential scanning calorimeter at a heating rate of 10° C./min to obtain a curve, drawing a tangent to each point (inflection point) of the curve where a transition initiates, and determining the temperature which corresponds to the intersection of the two tangents.

<Viscosity of Polyamide Resin Solution>

The viscosity of a polyamide resin solution can be measured using a rotational viscometer under the conditions of a measuring temperature of 25° C. Namely, a methanol/toluene=1/1 (by weight) solution is produced, and the polyamide resin to be examined is dissolved therein so as to result in a concentration of 5% by weight. This solution is examined with a rotational viscometer at an appropriate rotation speed under the conditions of a measuring temperature of 25° C. Thus, the viscosity of the solution can be ascertained.

<Polyamide Resin B>

It is preferable that the undercoat layer according to the invention should include, together with the polyamide resin A described above or in place of the polyamide resin A, a polyamide resin which contains: at least one of a linear dicarboxylic acid component and a branched dicarboxylic acid component; at least one of a lactam component and an aminocarboxylic acid component; and a polyether component.

With respect to the dicarboxylic acid component(s), both a linear component and a branched component may be contained, and a cyclic chain is included in neither the linear chain nor the branched chain. Both a lactam component and an aminocarboxylic acid component may be contained.

From the standpoints of electrical property and adhesion, it is more preferable that the polyamide resin should be a block copolymerized polyamide resin including: a polyamide block which includes at least one of a linear dicarboxylic acid component and a branched dicarboxylic acid component and further includes at least one of a lactam component and an aminocarboxylic acid component; and a polyether block which includes a polyether component. It is especially preferable that the block copolymerized polyamide resin should be represented by the following general formula [1].

[Chem. 2]

$$\text{-[HS-SS]n-} \qquad [1]$$

(In formula [1], HS represents a hard segment, which is a polymer unit including at least one kind of polyamide block that includes at least one of a lactam component and an aminocarboxylic acid component and further includes at least one of a linear dicarboxylic acid component and a branched dicarboxylic acid component; and SS represents a soft segment, which is a polymer unit including a polyether block that includes at least one kind of polyether component.)

The lactam and the aminocarboxylic acid are as follows. The number of carbon atoms thereof is usually 2 or larger, preferably 4 or larger, more preferably 6 or larger, from the standpoints of profitability and availability. The upper limit thereof is usually 20 or less, preferably 16 or less, more preferably 12 or less.

Examples thereof include lactam compounds such as α-lactams, β-lactams, γ-lactams, δ-lactams, ε-lactams (caprolactam), and ω-lactams (lauryllactam and dodecanelactam) and aminocarboxylic acids such as 6-aminocaproic acid, 7-aminoheptanoic acid, 9-aminononanoic acid, 11-aminoundecanoic acid, and 12-aminododecanoic acid.

Preferred from the standpoints of profitability and availability are caprolactam, dodecanelactam, 11-aminoundecanoic acid, and 12-aminododecanoic acid. A plurality of components selected from such lactams and aminocarboxylic acids can be used. It is, however, preferred to use a single component (single structure), and it is more preferable that the polyamide block should be obtained by polymerizing at least one of a lactam having a single structure and an aminocarboxylic acid having a single structure.

The amount of the lactam and aminocarboxylic acid components is as follows. The lower limit thereof is usually 1 mol % or larger based on the whole polyamide block. From the standpoints of water resistance, wear resistance, and impact resistance, the lower limit thereof is preferably 10 mol % or larger, more preferably 30 mol % or larger, especially preferably 50 mol % or larger. The upper limit thereof is usually 99 mol % or less based on the whole polyamide block. From the standpoints of profitability and ease of production, the upper limit thereof is preferably 80 mol % or less, more preferably 70 mol % or less.

The linear or branched dicarboxylic acid is as follows. The number of carbon atoms thereof is usually 2 or larger, preferably 3 or larger, more preferably 4 or larger, from the standpoints of profitability and availability. The upper limit thereof is usually 32 or less, preferably 26 or less, more preferably 22 or less.

Examples thereof include: saturated aliphatic dicarboxylic acids such as oxalic acid, malonic acid, succinic anhydride, maleic anhydride, glutaric acid, adipic acid, pimelic acid, suberic acid, azelaic acid, sebacic acid, dodecanedioic acid, 1,16-hexadecanedicarboxylic acid, and 1,18-octadecanedicarboxylic acid; aliphatic monounsaturated fatty acids such as phthalic acid, isophthalic acid, terephthalic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, and eicosenoic acid; and diunsaturated fatty acids such as decadiene acid, undecadiene acid, dodecadiene acid, tridecadiene acid, tetradecadiene acid, pentadecadiene acid, hexadecadiene acid, heptadecadiene acid, octadecadiene acid, nonadecadiene acid, eicosadiene acid, and docosadiene acid.

From the standpoint of improving the degree of elastic deformation, linear saturated aliphatic dicarboxylic acids are preferred. Specifically, adipic acid, suberic acid, azelaic acid, sebacic acid, and dodecanedioic acid are preferred from the standpoint of ease of synthesis, and adipic acid is especially preferred from the standpoints of profitability and availability. A plurality of components selected from these can be used. It is preferable from the standpoint of electrical property that the block copolymerized polyamide resin should contain neither a dimer acid nor a cyclic dicarboxylic acid as a polymer component.

The amount of the dicarboxylic acid component is as follows. The lower limit thereof is usually 1 mol % or larger, preferably 3 mol % or larger, more preferably 5 mol % or larger, especially preferably 10 mol % or larger, based on the whole polyamide resin. The upper limit thereof is usually 50 mol % or less, preferably 45 mol % or less, more preferably 40 mol % or less, especially preferably 30 mol % or less, based on the whole polyamide resin.

Although a block which includes both the dicarboxylic acid component and the lactam and/or aminocarboxylic acid component is called a polyamide block, examples of other components which may be contained in the polyamide block include diamines, cyclic dicarboxylic acids, and tricarboxylic acids.

The polyether block is not limited so long as a polyether component is included therein. Examples of the polyether component include poly($C_{2-6}$ alkylene) glycols and poly ($C_{2-4}$ alkylene) glycols, such as polyethylene glycol (PEG), polypropylene glycol (PPG), and polytetramethylene glycol (PTMG). From the standpoint of lowly water-absorbing property, it is preferable that polypropylene glycol (PPG) or polytetramethylene glycol (PTMG), among those polyether components, should be contained in the polyether block. Both PPG and PTMG may be contained. A plurality of components selected from those can be used.

Examples of other components which may be contained in the polyether block include dicarboxylic acids and tricarboxylic acids.

The amount of the polyether component is as follows. From the standpoint of adhesion, the lower limit thereof is usually 1 mol % or larger, preferably 3 mol % or larger, more preferably 5 mol % or larger, especially preferably 10 mol % or larger, based on the whole polyamide resin. From the standpoint of electrical property, the upper limit thereof is usually 90 mol % or less, preferably 85 mol % or less, more preferably 80 mol % or less, especially preferably 70 mol % or less, based on the whole polyamide resin.

Meanwhile, the amount of the polyether component in the undercoat layer is as follows. From the standpoint of adhesion, the lower limit thereof is usually 1% by mass or larger, preferably 3% by mass or larger, more preferably 5% by mass or larger, especially preferably 10% by mass or larger, based on the undercoat layer. From the standpoint of electrical property, the upper limit thereof is usually 50% by mass or less, preferably 45% by mass or less, more preferably 40% by mass or less, especially preferably 30% by mass or less, based on the undercoat layer.

The content of the polyether block in the undercoat layer is as follows. From the standpoint of adhesion, the lower limit thereof is usually 1% by mass or higher, preferably 3% by mass or higher, more preferably 5% by mass or higher, especially preferably 8% by mass or higher, based on the undercoat layer. From the standpoint of electrical property, the upper limit thereof is usually 60% by mass or less, preferably 50% by mass or less, more preferably 45% by mass or less, especially preferably 35% by mass or less, based on the undercoat layer.

Examples of other components which may be contained in the block copolymerized polyamide resin configured of the polyamide block and the polyether block include diamines such as hexamethylenediamine, nonamethylenediamine, dodecamethylenediamine, and piperazine and tricarboxylic acids such as trimellitic acid and trimesic acid. It is preferable from the standpoint of electrical property that the block copolymerized polyamide resin should contain no diamine component as a polymer component.

It is preferable that the amounts of the following components in the block copolymerized polyamide resin should be regulated so as to be within the following ranges, in which the sum of all the components is 100% by weight.

The amount of the polyether component is as follows. The lower limit thereof is usually 15% by weight or larger, preferably 30% by weight or larger, more preferably 70% by weight or larger. The upper limit thereof is usually 90% by weight or less, preferably 80% by weight or less.

The total amount of the lactam and aminocarboxylic acid components is as follows. The lower limit thereof is usually 5% by weight or larger, preferably 10% by weight or larger, more preferably 20% by weight or larger. The upper limit thereof is usually 50% by weight or less, preferably 30% by weight or less.

The total amount of the linear and branched dicarboxylic acid components is as follows. The lower limit thereof is usually 0.5% by weight or larger, preferably 1% by weight or larger, more preferably 2% by weight or larger. The upper limit thereof is usually 20% by weight or less, preferably 10% by weight or less.

In the block copolymerized polyamide resin represented by formula [1], it is preferable that the HS and the SS should have been bonded to each other by an ester bond because this structure makes it possible to obtain advantageous properties concerning low-temperature rigidification (flexible grade), density, hydrolytic resistance (lowly water-absorbing properties), and aging resistance (resistance to thermal oxidation and ultraviolet resistance).

The number-average molecular weight of the SS is as follows. The lower limit thereof is usually 100 or higher, and is preferably 300 or higher, more preferably 500 or higher, from the standpoint of adhesion. The upper limit thereof is usually 10,000 or less, and is preferably 6,000 or less, more preferably 4,000 or less, from the standpoint of solvent solubility.

The number-average molecular weight of the HS is as follows. The lower limit thereof is usually 300 or higher, and is preferably 500 or higher, more preferably 600 or higher, from the standpoint of adhesion. The upper limit thereof is usually 10,000 or less, and is preferably 6,000 or less, more preferably 4,000 or less, from the standpoint of solvent solubility.

The proportion of the HS to the SS (mass ratio) is as follows. The upper limit of HS/SS is usually 85/15 or less. From the standpoint of the adhesiveness of the polyamide resin, the upper limit thereof is preferably 70/30 or less, more preferably 50/50 or less, especially preferably 45/55 or less. The lower limit of HS/SS is usually 10/90 or larger, preferably 15/85 or larger, more preferably 20/80 or larger, especially preferably 25/75 or larger, from the standpoints of impact resistance, mechanical strength, and thermal property.

The amino group concentration of the block copolymerized polyamide resin represented by general formula [1] is not particularly limited. However, the lower limit thereof is usually 10 mmol/kg or higher. From the standpoint of adhesiveness, the lower limit thereof is preferably 15 mmol/kg or higher, more preferably 20 mmol/kg or higher. The upper limit thereof is usually 300 mmol/kg or less, and is preferably 280 mmol/kg or less, more preferably 250 mmol/kg or less, from the standpoint of electrical property.

The carboxyl group concentration of the polyamide resin is not particularly limited. However, the lower limit thereof is usually 10 mmol/kg or higher, and is preferably 15 mmol/kg or higher, more preferably 20 mmol/kg or higher, from the standpoints of high thermal stability and long-term stability. The upper limit thereof is usually 300 mmol/kg or less, and is preferably 280 mmol/kg or less, more preferably 250 mmol/kg or less, from the standpoint of electrical property.

The number-average molecular weight of the polyamide resin is as follows. The lower limit thereof is usually 5,000 or higher, and is preferably 6,000 or higher, more preferably 7,000 or higher, from the standpoint of evenness in undercoat layer thickness. The upper limit thereof is usually 200,000 or less, and is preferably 100,000 or less, more preferably 70,000 or less, from the standpoint of the solubility of the resin in solvents.

Incidentally, number-average molecular weight can be determined through an examination by gel permeation chromatography using HFIP (hexafluoroisopropanol) as a solvent and through calculation for poly(methyl methacrylate).

The amide bond content of the polyamide resin can be selected from the range of up to 100 units per molecule of the block copolymerized polyamide resin. The lower limit thereof is usually 30 units or more from the standpoint of leakage prevention, and is preferably 40 units or more, more preferably 50 units or more, from the standpoints of thermal fusion-bondability and compatibility. The upper limit thereof is usually 90 units or less, and is preferably 80 units or less, more preferably 70 units or less, from the standpoint of water-absorbing property. Incidentally, amide bond content can be calculated, for example, by dividing the number-average molecular weight by the molecular weight of the repeating unit (one unit).

The polyamide resin may be amorphous or may have crystallinity. The degree of crystallinity of the block copolymerized polyamide resin is 20% or less, preferably 10% or less. Incidentally, the degree of crystallinity can be determined by a common method, e.g., a measuring method based on density or heat of fusion, X-ray diffractometry, or infrared absorption method.

The melting point or softening point of the polyamide resin is as follows. The lower limit thereof is usually 75° C. or higher, and is preferably 90° C. or higher, more preferably 100° C. or higher, from the standpoint of the minimum drying temperature of the electrophotographic photoreceptor. The upper limit thereof is usually 160° C. or lower, and is preferably 140° C. or lower, more preferably 130° C. or lower, from the standpoint of the maximum drying temperature of the electrophotographic photoreceptor.

In the case where the components are in a compatibilized state and the block copolymerized polyamide resin shows a single peak when examined with a differential scanning calorimeter (DSC), the melting point of this resin means the temperature which corresponds to the single peak. In the case where the components are not in a compatibilized state and the block copolymerized polyamide resin shows a plurality of peaks when examined with a DSC, the temperature which corresponds to the higher-temperature-side peak, among the plurality of peaks, means the melting point of the block copolymerized polyamide resin. Thermal fusibility can be determined in terms of softening temperature measured with a differential scanning calorimeter. The melting point of the block copolymerized polyamide resin which is crystalline can be measured with a differential scanning calorimeter.

<Processes for Producing Polyamide Resins A and B>

Processes for producing the polyamide resins are not particularly limited, and known methods such as those shown in JP-A-2010-222396 and JP-A-2002-371189 can be used.

Practically, two production processes, i.e., a two-step method and a one-step method, are used.

In the two-step method, a polyamide block is produced first and the polyamide block is bonded to a polyether block in the second step.

In the one-step method, a polyamide precursor is mixed with a chain restriction agent and a polyether. Basically, polymers having a polyether block and a polyamide block which have any of various lengths are obtained, and various reactants react randomly (statistically) and are distributed in the polymer chains.

It is preferable that both the one-step method and the two-step method should be conducted in the presence of a catalyst. In the one-step method, a polyamide block is also yielded. Namely, the polyamide resin can be produced by any desired means for bonding a polyamide block and a polyether block to each other.

A process for producing a compound including a polyamide block which contains a terminal carboxylic acid group and a polyether which is a polyether diol is explained in detail.

In a two-step method, a polyamide precursor is first condensed in the presence of a dicarboxylic acid as a chain restriction agent to form a polyamide block having a terminal carboxylic acid group, and a polyether and a catalyst are added in the second step. In the case where the polyamide precursor is constituted only of either a lactam or an α,ω-aminocarboxylic acid, a dicarboxylic acid is added. In the case where the polyamide precursor has been configured from a dicarboxylic acid, a diamine is used in an excess amount in terms of chemical equivalent. The reaction is conducted generally at 180-300° C., preferably at 200-260° C., and the internal pressure of the reactor is regulated to 5-30 bars and kept at this value for about 2 hours. The reactor is degassed to gradually lower the pressure, and the excess water is removed by distillation conducted, for example, for 1-2 hours.

Next, after the production of a polyamide having a terminal carboxylic acid group, a polyether and a catalyst are added. The polyether and the catalyst can be added at a time or multiple times. In a preferred embodiment, the polyether is added first. The reaction of the terminal —OH group of the polyether with the terminal —COOH group of the polyamide, formation of an ester bond, and elimination of water begin simultaneously.

The water in the reaction mixture is removed as much as possible by distillation. Thereafter, a catalyst is introduced to complete the bonding of the polyamide block to the polyether block. This second step preferably is conducted while stirring the reaction mixture at a reduced pressure of 5 mmHg (650 Pa) or lower at such a temperature that the reactants and the copolymer obtained are in a molten state. This temperature can be, for example, 100-400° C., generally 200-300° C. The reaction is monitored by measuring the torque applied from the molten polymer to the stirrer or by measuring the electric power consumed by the stirrer, and an end point of the reaction is determined on the basis of the torque or the value of electric-power consumption.

The term catalyst means any desired compound which bonds the polyamide block to the polyether block through esterification. Advantageous as this catalyst is a derivative of a metal (M) selected from the group consisting of titanium, zirconium, and hafnium. Examples of the derivative include tetraalkoxides represented by the general formula $M(OR)_4$, wherein M represents titanium, zirconium, or hafnium and R represents a linear or branched alkyl group having 1-24 carbon atoms, and the multiple R groups may be the same or different.

The $C_1$-$C_{24}$ alkyl groups in the R groups in the tetraalkoxides usable as the catalyst are, for example, methyl, ethyl, propyl, isopropyl, butyl, ethylhexyl, decyl, dodecyl, hexadodecyl, or the like.

Preferred catalysts are tetraalkoxides in which the R groups are $C_1$-$C_8$ alkyl groups (the multiple R groups may be the same or different). Examples of such catalysts include, in particular, $Zr(OCH_2H_5)_4$, $Zr(O\text{-}isoC_3H_7)_4$, $Zr(OC_4H_9)_4$, $Zr(OC_5H_{11})_4$, $Zr(OC_6H_{13})_4$, $Hf(OC_2H_5)_4$, $Hf(OC_4H_9)_4$, or $Hf(O\text{-}isoC_3H_7)_4$.

The catalyst may be constituted only of one or more tetraalkoxides represented by the formula $M(OR)_4$. However, a combination of the one or more tetraalkoxides with one or more alkali metal or alkaline earth metal alcoholates represented by the formula $(R^1O)_pY$ may also be used as the catalyst. In the formula, $R^1$ represents a hydrocarbon residue, preferably a $C_1$-$C_{24}$ alkyl residue, more preferably a $C_1$-$C_8$ alkyl residue, Y represents an alkali metal or an alkaline earth metal, and p is the valence of Y.

The amounts of the alkali metal or alkaline earth metal alcoholate(s) and the zirconium or hafnium tetraalkoxide(s) which are used in combination as a mixed catalyst can be varied in wide ranges. It is, however, preferred to use the alcoholate(s) and the tetraalkoxide(s) in such amounts that the molar proportion of the alcoholate(s) is substantially the same as the molar proportion of the tetraalkoxide(s).

It is preferable that the mass proportion of the catalyst, i.e., the amount of the one or more tetraalkoxides in cases when the catalyst does not include any alkali metal or alkaline earth metal alcoholate or the amount of both the one or more tetraalkoxides and the one or more alkali metal or alkaline earth metal alcoholates in cases when the catalyst is configured of a combination of these two kinds of compounds, should be regulated to 0.01-5%, preferably 0.05-2%, based on the mass of the mixture of the dicarboxylic acid/polyamide and the polyalkylene glycol.

Other examples of the derivative include metal (M) salts. Specific examples thereof include salts of a metal (M) with an organic acid and complex salts of a metal (M) oxide and/or a metal (M) hydroxide with an organic acid.

The organic acid can be formic acid, acetic acid, propionic acid, butyric acid, valeric (valerique) acid, caproic acid, caprylic acid, lauric acid, myristic acid, palmitic acid, stearic acid, oleic acid, linolic acid, linolenic acid, cyclohexanecarboxylic acid, phenylacetic acid, benzoic acid, salicylic acid, oxalic acid, malonic acid, succinic acid, glutaric acid, adipic acid, maleic acid, fumaric acid, phthalic acid, and crotonic acid. Especially preferred of these are acetic acid and propionic acid. Salts in which the metal is zirconium are advantageous. These salts can be called zirconyl salts.

These salts of zirconium with organic acids or the complex salts are thought to release $ZrO^{++}$ during the process. However, this explanation is not restrictive. A commercial product available under the name of zirconyl acetate is usable, and the amount of this salt to be used is the same as that of $M(OR_4)$ derivatives.

A process for producing a compound including a polyamide block which contains a terminal carboxylic acid group and a polyether which is a polyether diamine is explained in detail.

In a two-step method, a polyamide precursor is first condensed in the presence of a dicarboxylic acid as a chain restriction agent to form a polyamide block having a terminal carboxylic acid group, and a polyether is added in the second step optionally together with a catalyst.

In the case where the polyamide precursor is constituted only of either a lactam or an α,ω-aminocarboxylic acid, a dicarboxylic acid is added. In the case where the polyamide precursor has been configured from a dicarboxylic acid, a diamine is used in an excess amount in terms of chemical equivalent. The reaction is conducted generally at 180-300° C., preferably at 200-260° C., and the internal pressure of the reactor is regulated to 5-30 bars and kept at this value for about 2 hours. The reactor is degassed to gradually lower the pressure, and the excess water is removed by distillation conducted, for example, for 1-2 hours.

After the production of a polyamide having a terminal carboxylic acid group, a polyether is added optionally together with a catalyst. The polyether and the catalyst can be added at a time or multiple times. In a preferred embodiment, the polyether is added first. The reaction of the terminal —$NH_2$ group of the polyether with the terminal —COOH group of the polyamide, formation of an amide bond, and elimination of water begin simultaneously.

The water in the reaction mixture is removed as much as possible by distillation. Thereafter, a catalyst is introduced according to need to complete the bonding of the polyamide block to the polyether block. This second step preferably is conducted while stirring the reaction mixture at a reduced pressure of 5 mmHg (650 Pa) or lower at such a temperature that the reactants and the copolymer obtained are in a molten state. This temperature may be, for example, 100-400° C., generally 200-300° C.

The reaction is monitored by measuring the torque applied from the molten polymer to the stirrer or by measuring the electric power consumed by the stirrer, and an end point of the reaction is determined on the basis of the torque or the value of electric-power consumption. The term catalyst means any desired compound which bonds the polyamide block to the polyether block through esterification. Protonic catalysts are preferred.

In a one-step method, all the reactants to be used in the two-step method, e.g., a polyamide precursor, a dicarboxylic acid as a chain restriction agent, and a polyether, and a catalyst are mixed together. These ingredients are the same as the reactants and catalyst used in the two-step method. In the case where the polyamide precursor is constituted only of a lactam, addition of a small amount of water is advantageous.

Although the copolymer basically has the same polyether blocks and the same polyamide blocks, it is possible to react any of various reactants in a small amount by any desired method to randomly distribute units of the reactant in the polymer chain. As in the first step of the two-step method described above, the reactor is closed and the contents are heated with stirring. The pressure is regulated to 5-30 bars. After the reaction mixture has come not to change any more, the reactor is evacuated while vigorously agitating the molten reactants. The subsequent procedure is the same as in the two-step method.

<Method for Forming Undercoat Layer>

It is desirable that the undercoat layer should be formed so as to include the metal oxide particles dispersed in a binder. Besides being either of the polyamide resins described above, the binder resin for use in the undercoat layer may be a mixture of the polyamide resin with other resin(s).

Examples of the resins which may be mixed include known binder resins such as epoxy resins, polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, poly (vinyl acetal) resins, vinyl chloride/vinyl acetate copolymers, poly(vinyl alcohol) resins, polyurethane resins, poly (acrylic acid) resins, polyacrylamide resins, polyvinylpyrrolidone resins, polyvinylpyridine resins, water-soluble polyester resins, cellulose ester resins such as nitrocellulose, cellulose ether resins, casein, gelatin, poly (glutamic acid), starch, starch acetate, aminostarch, organozirconium compounds such as zirconium chelate compounds and zirconium alkoxide compounds, organic titanyl compounds such as titanyl chelate compounds and titanyl alkoxide compounds, and silane coupling agents. These resins can be used also in a cured form obtained with a hardener.

<Photosensitive Layer>

The photoreceptors of the invention each have a photosensitive layer formed over the conductive support. The photoreceptors of the invention each may be either a multilayer type photoreceptor having a photosensitive layer of a multilayer type (multilayer type photosensitive layer) including a charge generation layer (layer containing a charge generation material) and a charge transport layer (layer containing a charge transport material) or a single-layer type photoreceptor in which a charge generation material and a charge transport material are contained in the same photosensitive layer (single-layer type photosensitive layer).

<Multilayer Type Photosensitive Layer>

(Charge Generation Layer)

The charge generation layer of the multilayer type photosensitive layer (function allocation type photosensitive layer) contains a charge generation material and usually further contains a binder resin and other ingredients which are used according to need. Such a charge generation layer can be obtained, for example, in the following manner. A charge generation material or charge generation substance and a binder resin are dissolved or dispersed in a solvent or dispersion medium to produce a coating fluid (coating fluid for charge generation layer formation). In the case of a normal-stack type photosensitive layer, the coating fluid is applied on a conductive support (or on an undercoat layer in the case where the undercoat layer has been provided). Meanwhile, in the case of a reverse-stack type photosensitive layer, the coating fluid is applied on a charge transport layer. The coating fluid applied is dried. Thus, the charge generation layer can be obtained.

Usable examples of the charge generation substance are various photoconductive materials including: inorganic photoconductive materials such as selenium, alloys thereof, and cadmium sulfide; organic pigments such as phthalocyanine pigments, azo pigments, quinacridone pigments, indigo pigments, perylene pigments, polycyclic quinone pigments, anthanthrone pigments, and benzimidazole pigments; and the like. Especially preferred are organic pigments. In particular, phthalocyanine pigments and azo pigments are more preferred. One charge generation substance may be used, or any desired two or more charge generation substances may be used in combination in any desired proportion.

In the case where a phthalocyanine compound, among these, is used as the charge generation substance, usable examples thereof include: metal-free phthalocyanines; and phthalocyanine compounds to which a metal, e.g., copper, indium, gallium, tin, titanium, zinc, vanadium, silicon, or germanium, or an oxide, halide, or another form of the metal has coordinated.

Examples of ligands coordinated to metal atoms having a valence of 3 or higher include hydroxyl and alkoxy groups besides oxygen and chlorine atoms as shown above. Suitable are X-form and τ-form metal-free phthalocyanines, which have especially high sensitivity, A-form, B-form, D-form, and other titanyl phthalocyanines, vanadyl phthalocyanines, chloroindium phthalocyanines, chlorogallium phthalocyanines, hydroxygallium phthalocyanines, and the like.

Of the crystal forms of titanyl phthalocyanine enumerated above, A-form and B-form were shown respectively as I-phase and II-phase by W. Heller et al. (*Zeit. Kristallogr.*, 159 (1982) 173); A-form is also called n-form and is known as a stable form. D-form is also called Y-form and is a metastable crystal form characterized by showing a distinct peak at a diffraction angle $2\theta \pm 0.2°$ of 27.3° in X-ray powder diffractometry using a CuKα line.

A single phthalocyanine compound may be used as the only phthalocyanine compound, or some phthalocyanine compounds may be used in a mixed state. This mixed state of phthalocyanine compounds or of crystal states to be used here may be a mixture obtained by mixing the components prepared beforehand, or may be a mixture which came into the mixed state during phthalocyanine compound production/treatment steps such as synthesis, pigment formation, crystallization, etc. Known as such treatments are an acid paste treatment, grinding, solvent treatment, and the like.

Meanwhile, in the case of using an azo pigment as the charge generation material, various conventionally known azo pigments can be used so long as the azo pigments have sensitivity to the light source for light input. However, various kinds of bisazo pigments and trisazo pigments are suitable.

Preferred examples of azo pigments are shown below.

[Chem. 3]

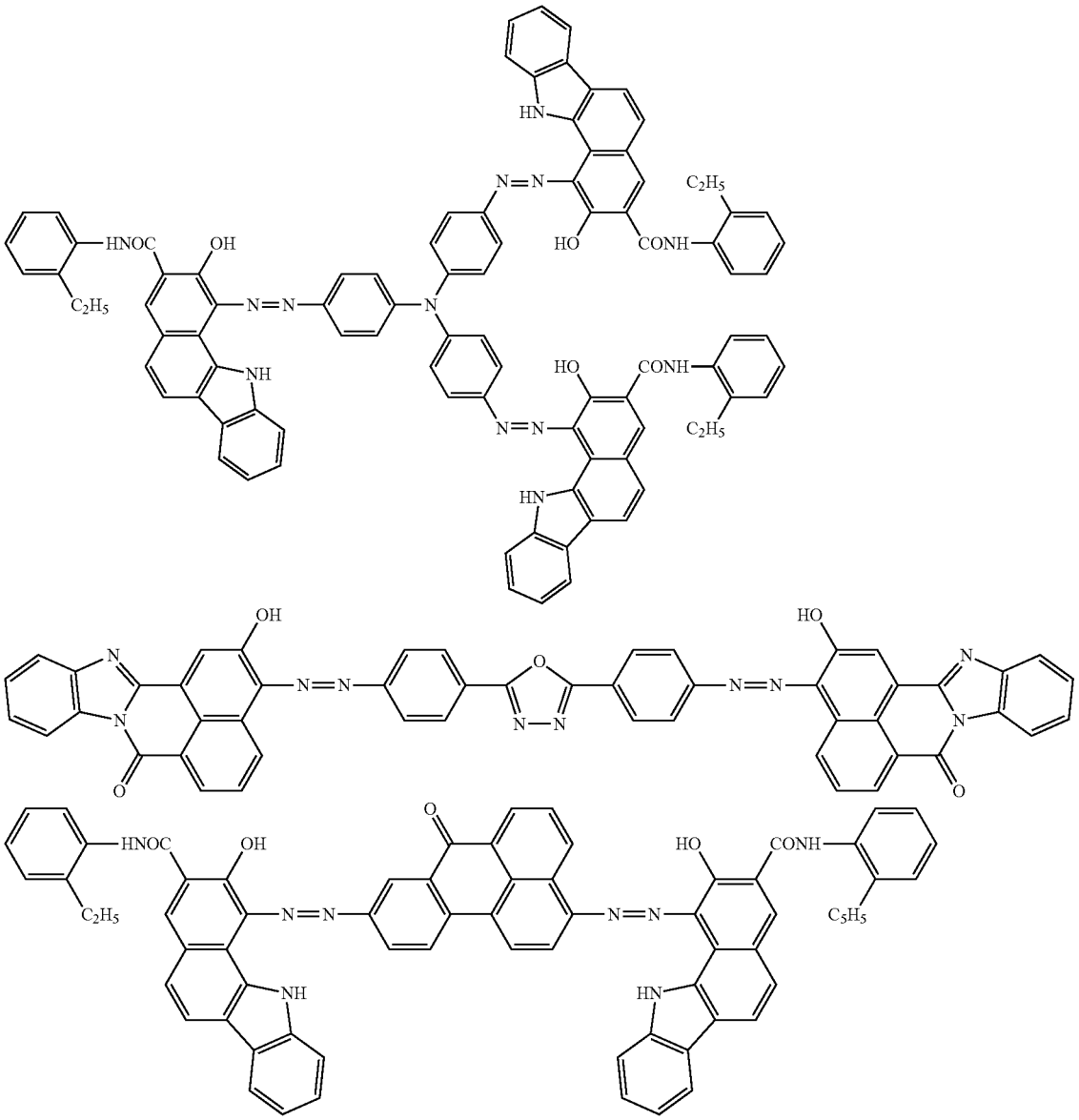

In the case where one or more of the organic pigments shown above as examples are used as the charge generation substance, two or more pigments may be used as a mixture thereof although one pigment may be used alone. In this case, it is preferable that two or more charge generation substances which have spectral sensitivity characteristics in different spectral regions, i.e., the visible region and the near-infrared region, should be used in combination. More preferred of such methods is to use a disazo pigment or trisazo pigment and a phthalocyanine pigment in combination.

These charge generation substances are usually used in the form of fine particles bound with any of various binder resins such as, for example, polyester resins, poly(vinyl acetate) resins, poly(acrylic ester) resins, poly(methacrylic ester) resins, polyester resins, polycarbonate resins, poly (vinyl acetoacetal) resins, poly(vinyl propional) resins, poly (vinyl butyral) resins, phenoxy resins, epoxy resins, urethane resins, cellulose esters, and cellulose ethers. Incidentally, the polyester resins according to the invention may be used as binder resins in this case. One binder resin may be used, or any desired two or more binder resins may be used in combination in any desired proportion.

The proportion of the charge generation substance used in the charge generation layer per 100 parts by mass of the binder resin is usually 30 parts by mass or higher, preferably 50 parts by mass or higher, and is usually 500 parts by mass or less, preferably 300 parts by mass or less.

The thickness of the charge generation layer is usually 0.1 μm or larger, preferably 0.15 μm or larger, and is usually 1 μm or less, preferably 0.6 μm or less.

The charge generation layer may contain ingredients other than those described above, unless the effects of the invention are considerably lessened thereby. For example, additives may be incorporated into the charge generation layer.

These additives are for improving film-forming properties, flexibility, applicability, nonfouling properties, gas resistance, light resistance, etc. Examples thereof include plasticizers, antioxidants, ultraviolet absorbers, electron-attracting compounds, dyes, pigments, leveling agents, residual-potential depressants, dispersion aids, visible-light-shielding agents, sensitizers, and surfactants.

The mechanical strength and the like of the layer can be improved with a plasticizer, and the residual potential can be reduced with a residual-potential depressant. The dispersion stability can be improved with a dispersion aid, and the applicability of the coating fluid can be improved with a leveling agent.

Examples of the antioxidants include hindered phenol compounds and hindered amine compounds. Examples of the dyes and pigments include various colorant compounds and azo compounds. Examples of the surfactants include silicone oils and fluorochemical oils. One additive may be used alone, or any desired two or more additives may be used in combination in any desired proportion.

Furthermore, a silicone oil or wax and particles of a resin such as a fluororesin, polystyrene resin, silicone resin, or the like may be incorporated into a surface layer for the purpose of reducing the frictional resistance and wear of the photoreceptor surface. Particles of an inorganic compound may also be incorporated.

(Charge Transport Layer)

The charge transport layer of the multilayer type photoreceptor contains a charge transport substance and a binder resin and may contain other ingredients which are used according to need. Such a charge transport layer can be obtained specifically by dissolving or dispersing a charge transport substance, etc. and a binder resin in a solvent to produce a coating fluid, applying this coating fluid on the charge generation layer in the case of a normal-stack type photosensitive layer or applying the coating fluid on the undercoat layer in the case of a reverse-stack type photosensitive layer, and drying the coating fluid applied.

As the charge transport substance, other known charge transport substances can be used. Although the kind thereof is not particularly limited, preferred examples thereof are carbazole derivatives, hydrazone compounds, aromatic amine derivatives, enamine derivatives, butadiene derivatives, and compounds each constituted of two or more of these derivatives bonded to each other. Specific examples of suitable structures of the charge transport substance are shown below. The following structures are mere examples, and any known charge transport substance may be used so long as the use thereof does not depart from the spirit of the invention.

[Chem. 4]

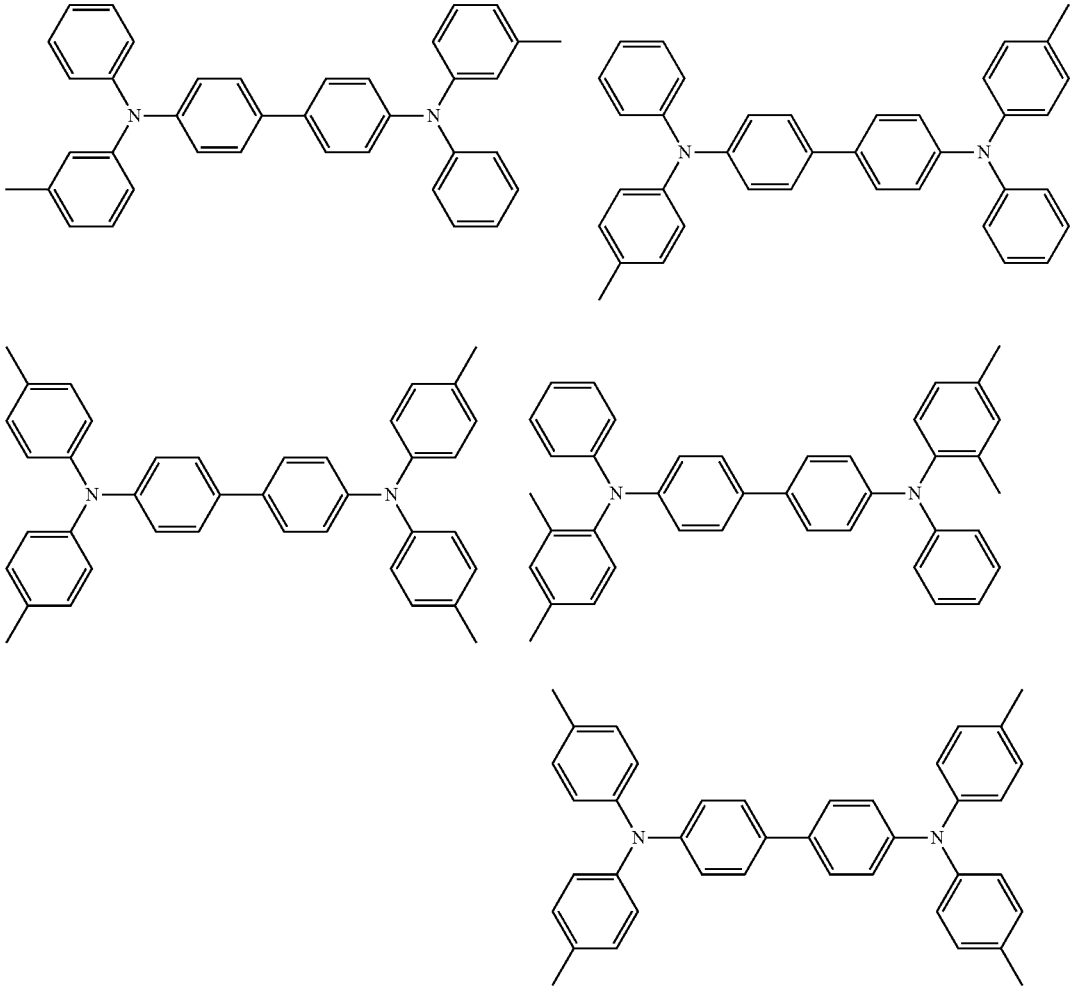

-continued
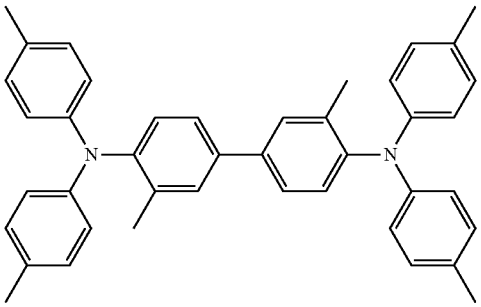
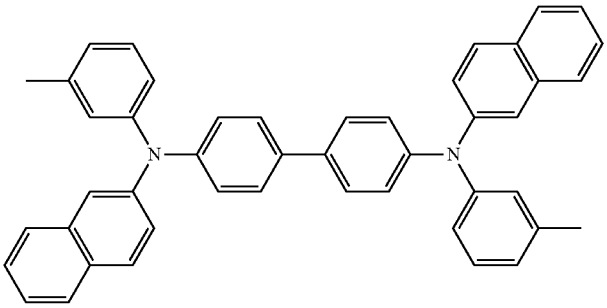
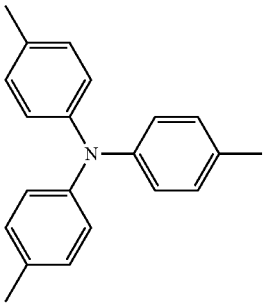
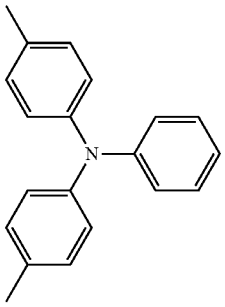
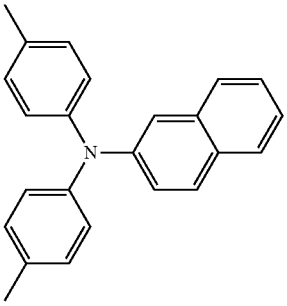
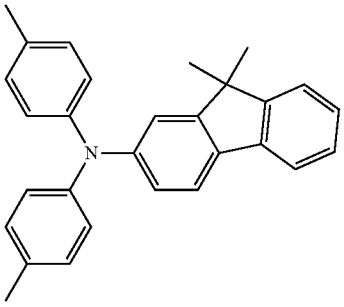
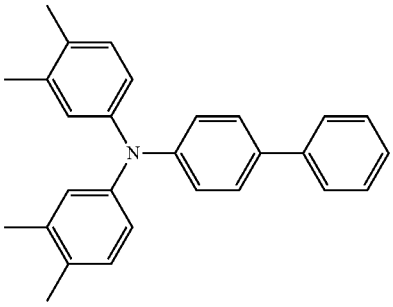
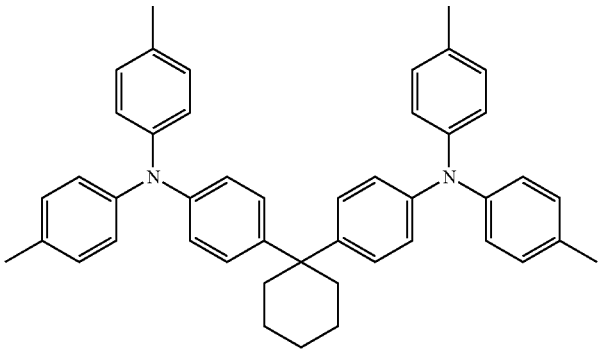
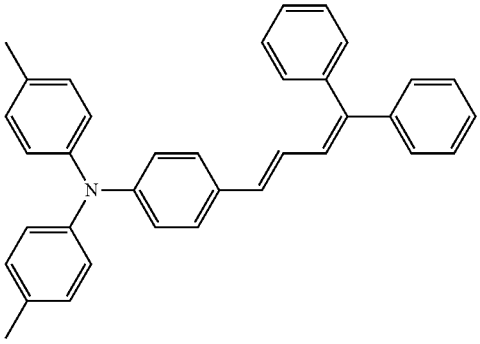
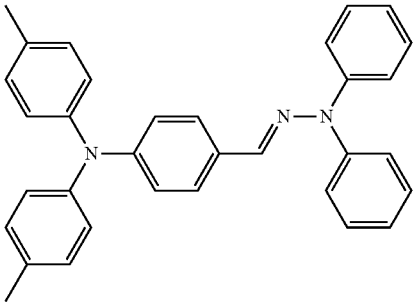
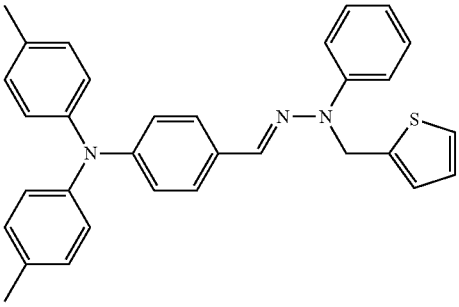

-continued
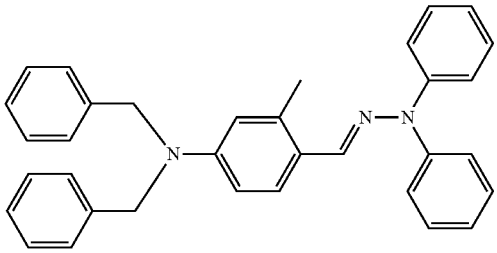
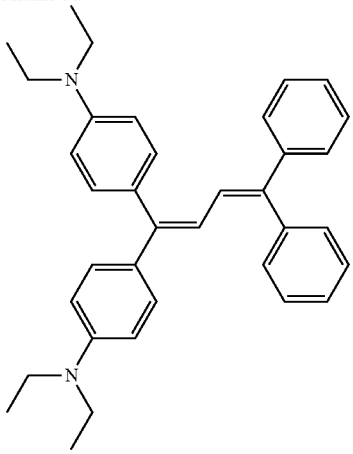
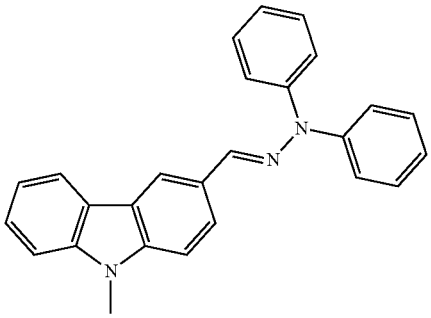
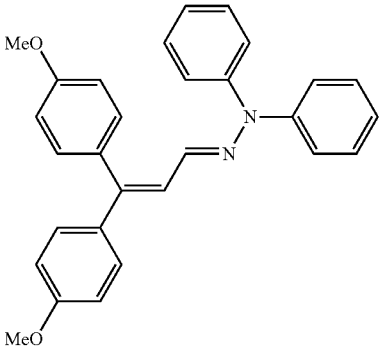
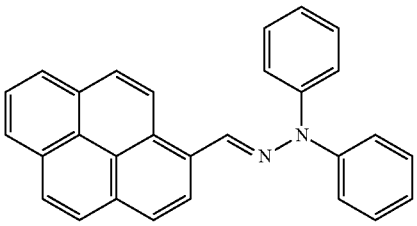
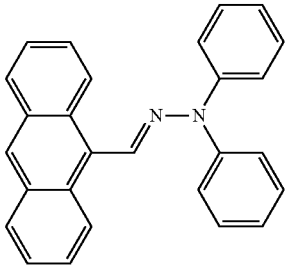
[Chem. 5]
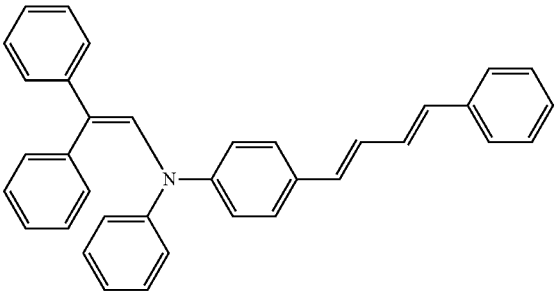
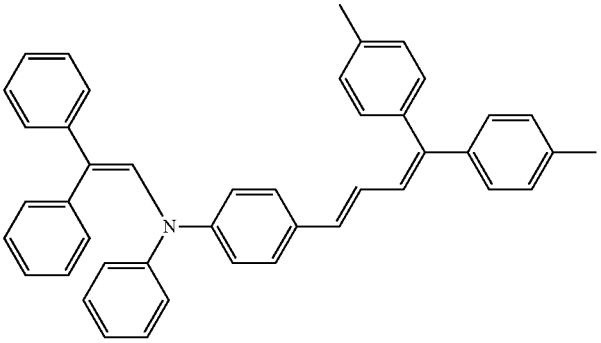

-continued
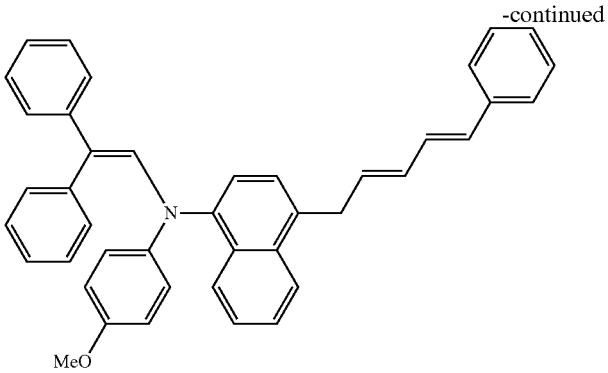
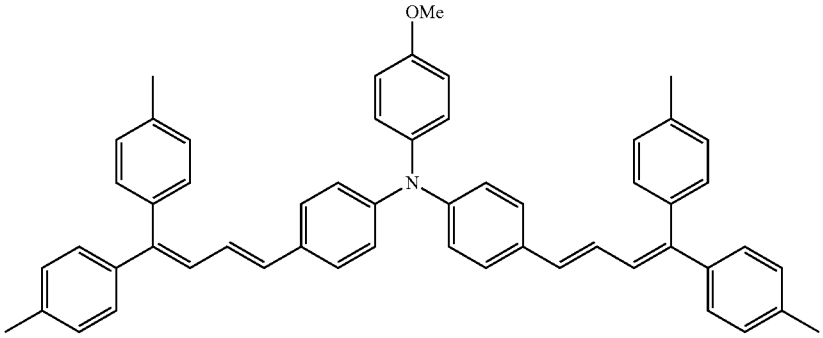
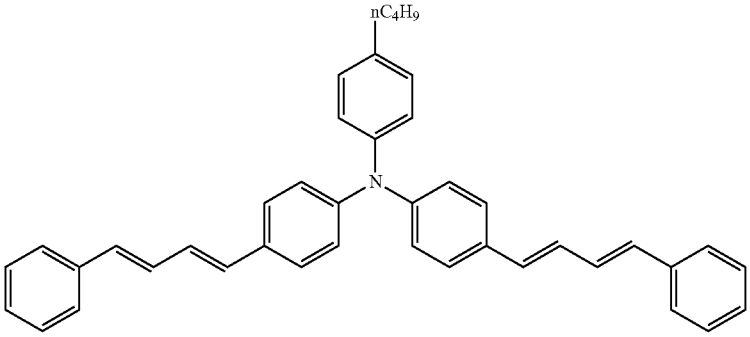
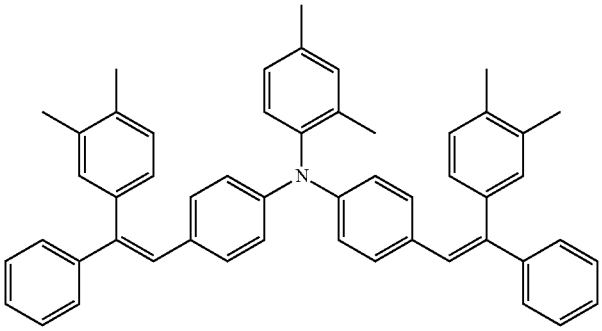
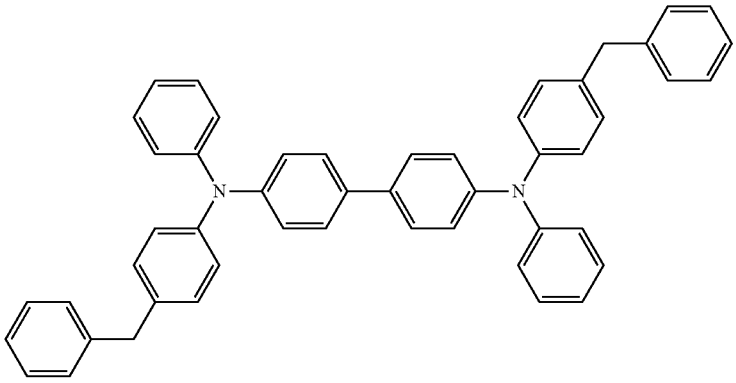

-continued
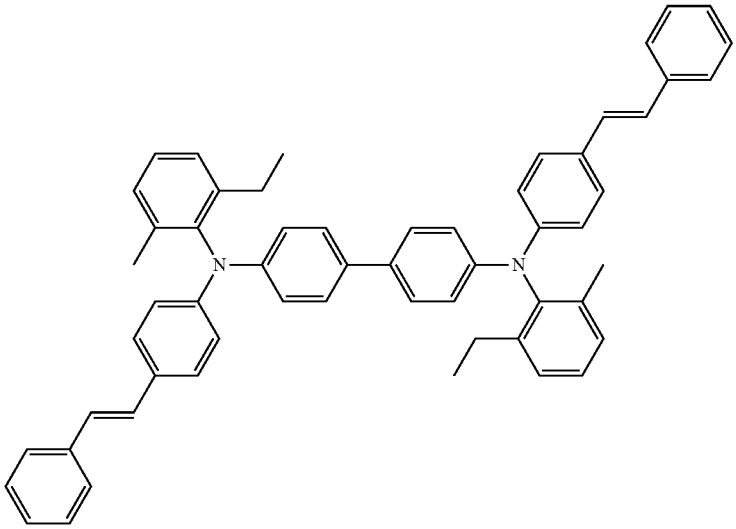
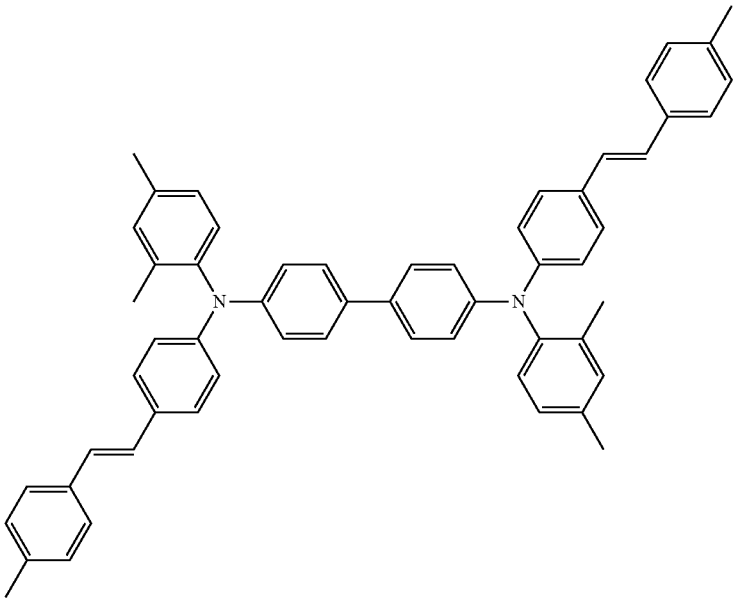
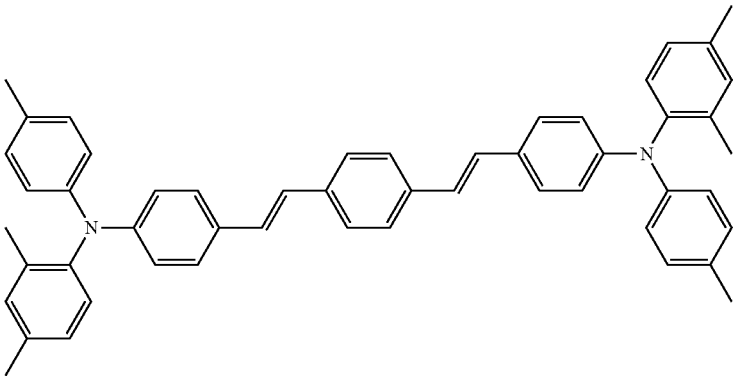

-continued
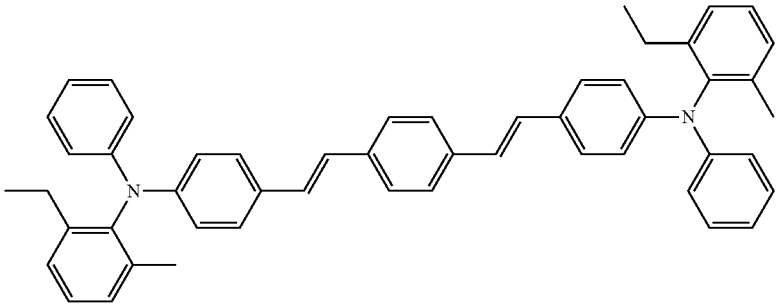
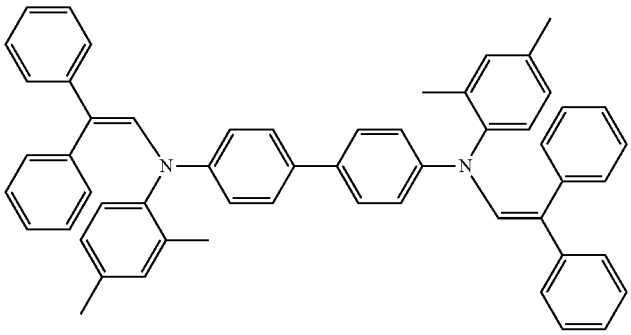
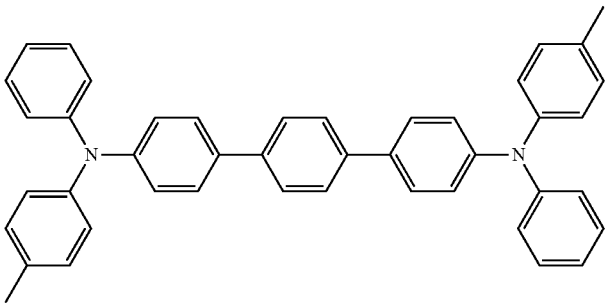
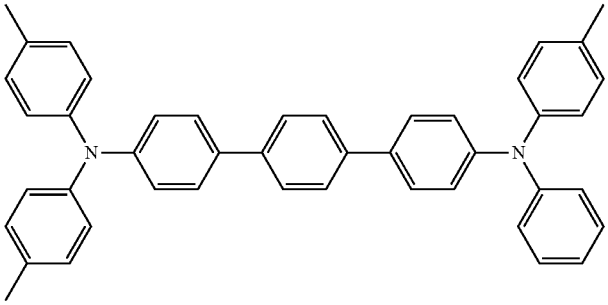
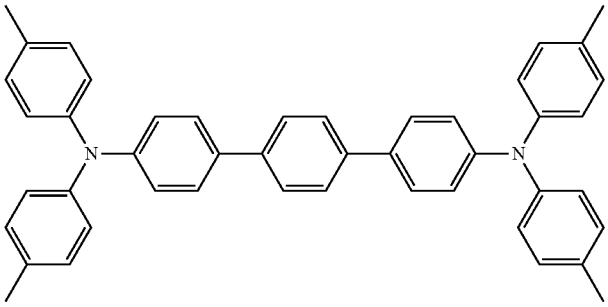

Suitable examples of the binder resin include polymers and copolymers of vinyl compounds, such as butadiene resins, styrene resins, vinyl acetate resins, vinyl chloride resins, acrylic ester resins, methacrylic ester resins, vinyl alcohol resins, and ethyl vinyl ether, and further include poly(vinyl butyral) resins, poly(vinyl formal) resins, partly modified poly(vinyl acetal), polyamide resins, polyurethane resins, cellulose ester resins, phenoxy resins, silicone resins, silicone/alkyd resins, poly(N-vinylcarbazole) resins, polycarbonate resins, and polyester resins. Preferred of these are polycarbonate resins and polyester resins. Polyester resins, in particular, wholly aromatic polyester resins called polyarylate resins, are capable of bringing about a higher degree of elastic deformation and are especially preferred from the standpoint of mechanical properties such as wear resistance, scratch resistance, and non-filming properties.

In general, polyester resins are superior to polycarbonate resins in mechanical property but are inferior to polycarbonate resins in electrical property and photofatigue. This is thought to be because the ester bond has higher polarity than the carbonate bond and shows higher acceptor characteristics.

First, polyester resins are explained. In general, a polyester resin is obtained by condensation-polymerizing starting-material monomers including a polyhydric alcohol ingredient and a polycarboxylic acid ingredient, e.g., a carboxylic acid, carboxylic acid anhydride, or carboxylic acid ester.

Examples of the polyhydric alcohol ingredient include alkylene (having 2 or 3 carbon atoms) oxide (average number of moles added, 1-10) adducts of bisphenol A, such as polyoxypropylene(2.2)-2,2-bis(4-hydroxyphenyl)propane and polyoxyethylene(2.2)-2,2-bis(4-hydroxyphenyl) propane, ethylene glycol, propylene glycol, neopentyl glycol, glycerin, pentaerythritol, trimethylolpropane, hydrogenated bisphenol A, sorbitol, alkylene (having 2 or 3 carbon atoms) oxide (average number of moles added, 1-10) adducts of these, and aromatic bisphenols. It is preferable that the polyhydric alcohol ingredient should include one or more of these compounds.

Meanwhile, examples of the polycarboxylic acid ingredient include dicarboxylic acids such as phthalic acid, isophthalic acid, terephthalic acid, fumaric acid, maleic acid, biphenyldicarboxylic acid, and (diphenyl ether)dicarboxylic acid, succinic acids substituted with an alkyl group having 1-20 carbon atoms or alkenyl group having 2-20 carbon atoms, such as dodecenylsuccinic acid and octylsuccinic acid, trimellitic acid, pyromellitic acid, the anhydrides of these acids, and alkyl (having 1-3 carbon atoms) esters of these acids. It is preferable that the polycarboxylic acid ingredient should include one or more of these compounds.

Preferred of these polyester resins are wholly aromatic polyester resins (polyarylate resins) having a structural unit represented by the following formula (A).

[Chem. 6]

(A)

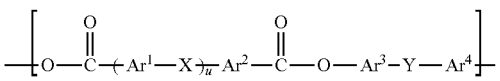

(In formula (A), $Ar^1$ to $Ar^4$ each independently represent an arylene group which may have a substituent, and X represents a single bond, an oxygen atom, a sulfur atom, or an alkylene group. Symbol u represents an integer of 0 to 2, and Y represents a single bond, an oxygen atom, a sulfur atom, or an alkylene group. When u is 2, the multiple $Ar^1$ groups may be the same or different and the multiple X bonds, atoms, or groups may be the same or different.)

In formula (A), $Ar^1$ to $Ar^4$ each independently represent an arylene group which may have a substituent. The number of carbon atoms of the arylene group is usually 6 or larger, preferably 7 or larger, and the upper limit thereof is usually 20 or less, preferably 10 or less, more preferably 8 or less. In case where the number of carbon atoms thereof is too large, there is the possibility of resulting not only in an increase in production cost but in impaired electrical properties.

Examples of $Ar^1$ to $Ar^4$ include 1,2-phenylene, 1,3-phenylene, 1,4-phenylene, naphthylene, anthrylene, and phenanthrylene. Preferred of these examples of the arylene groups is 1,4-phenylene, from the standpoint of electrical property. The arylene groups may be of one kind alone, or may be any desired combination of two or more kinds in any desired proportion.

Examples of the substituents of $Ar^1$ to $Ar^4$ include alkyl groups, aryl groups, halogen atoms, and alkoxy groups. When the mechanical properties of the binder resin for the photosensitive layer and the solubility thereof in coating fluids for photosensitive-layer formation are taken into account, preferred examples among those are methyl, ethyl, propyl, and isopropyl as alkyl groups, phenyl and naphthyl as aryl groups, fluorine, chlorine, bromine, and iodine atoms as halogen atoms, and methoxy, ethoxy, propoxy, and butoxy as alkoxy groups. In the case where any of the substituents is an alkyl group, the number of carbon atoms of the alkyl group is usually 1 or larger and is usually 10 or less, preferably 8 or less, more preferably 2 or less.

More specifically, it is preferable that $Ar^3$ and $Ar^4$ should each independently have no substituent or have up to two substituents. From the standpoint of adhesion, it is more preferable that $Ar^3$ and $Ar^4$ each should have one or more substituents. In particular, from the standpoint of wear resistance, it is especially preferable that $Ar^3$ and $Ar^4$ each should have one substituent. Preferred as the substituents are alkyl groups. Especially preferred is methyl.

Meanwhile, with respect to $Ar^1$ and $Ar^2$, it is preferable that these groups should each independently have no substituent or have up to two substituents. From the standpoint of wear resistance, it is more preferable that $Ar^1$ and $Ar^2$ each should have no substituent.

In formula (A), Y represents a single bond, oxygen atom, sulfur atom, or alkylene group. The alkylene group preferably is $—CH_2—$, $—CH(CH_3)—$, $—C(CH_3)_2—$, or cyclohexylene. More preferred is $—CH_2—$, $—CH(CH_3)—$, $—C(CH_3)_2—$, or cyclohexylene. Especially preferred is $—CH_2—$ or $—CH(CH_3)—$.

In formula (A), X is a single bond, oxygen atom, sulfur atom, or alkylene group. In particular, it is preferable that X should be an oxygen atom. In this case, u is preferably 0 or 1, especially preferably 1.

In the case where u is 1, preferred examples of the dicarboxylic acid residue include a diphenyl ether-2,2'-dicarboxylic acid residue, diphenyl ether-2,3'-dicarboxylic acid residue, diphenyl ether-2,4'-dicarboxylic acid residue, diphenyl ether-3,3'-dicarboxylic acid residue, diphenyl ether-3,4'-dicarboxylic acid residue, and diphenyl ether-4,4'-dicarboxylic acid residue. More preferred of these are a diphenyl ether-2,2'-dicarboxylic acid residue, diphenyl ether-2,4'-dicarboxylic acid residue, and diphenyl ether-4,4'-dicarboxylic acid residue, when the simplicity of production of the dicarboxylic acid ingredient is taken into account. Especially preferred is a diphenyl ether-4,4'-dicarboxylic acid residue.

In the case where u is 0, examples of the dicarboxylic acid residue include a phthalic acid residue, isophthalic acid residue, terephthalic acid residue, toluene-2,5-dicarboxylic acid residue, p-xylene-2,5-dicarboxylic acid residue, naphthalene-1,4-dicarboxylic acid residue, naphthalene-2,3-dicarboxylic acid residue, naphthalene-2,6-dicarboxylic acid residue, biphenyl-2,2'-dicarboxylic acid residue, and biphenyl-4,4'-dicarboxylic acid residue. Preferred are a phthalic acid residue, isophthalic acid residue, terephthalic acid residue, naphthalene-1,4-dicarboxylic acid residue, naphthalene-2,6-dicarboxylic acid residue, biphenyl-2,2'-dicarboxylic acid residue, and biphenyl-4,4'-dicarboxylic acid residue. Especially preferred are an isophthalic acid residue and a terephthalic acid residue. It is possible to use a plurality of these carboxylic acid residues in combination.

Specific examples of suitable structures of the binder resin are shown below. The following structures are mere examples, and any known binder resin may be used so long as the use thereof does not depart from the spirit of the invention.

Next, polycarbonate resins are explained. In general, polycarbonate resins in extensive use include ones produced by solvent processes, such as an interfacial process (interfacial polycondensation) or a solution process, in which a bisphenol compound is reacted with phosgene in solution. In addition, a melt process in which a bisphenol and a carbonic acid diester are subjected to polycondensation reaction by transesterification is in extensive use as an inexpensive production process. Suitable for use as the bisphenol compound are the following compounds. As the polycarbonate resins, use may be made of not only homopolymers each produced from a single bisphenol compound but also copolymers each produced by copolymerizing two or more bisphenol compounds.

[Chem. 8]

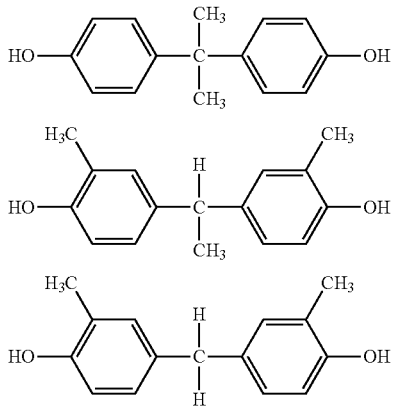

[Chem. 7]

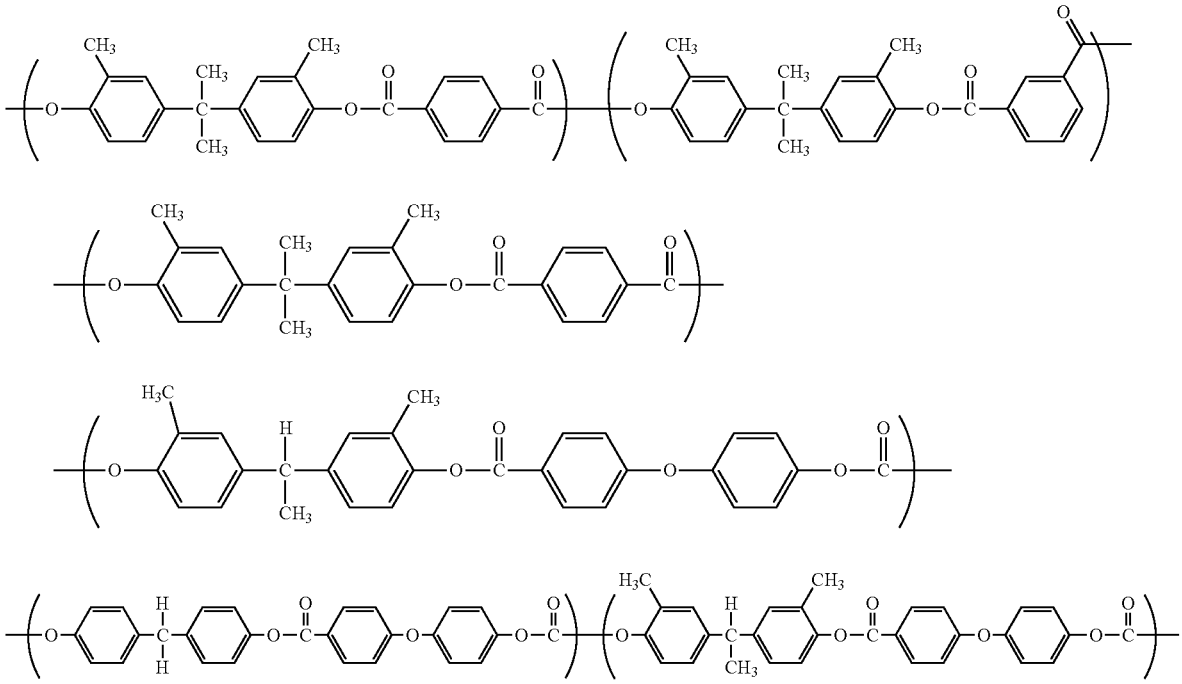

-continued
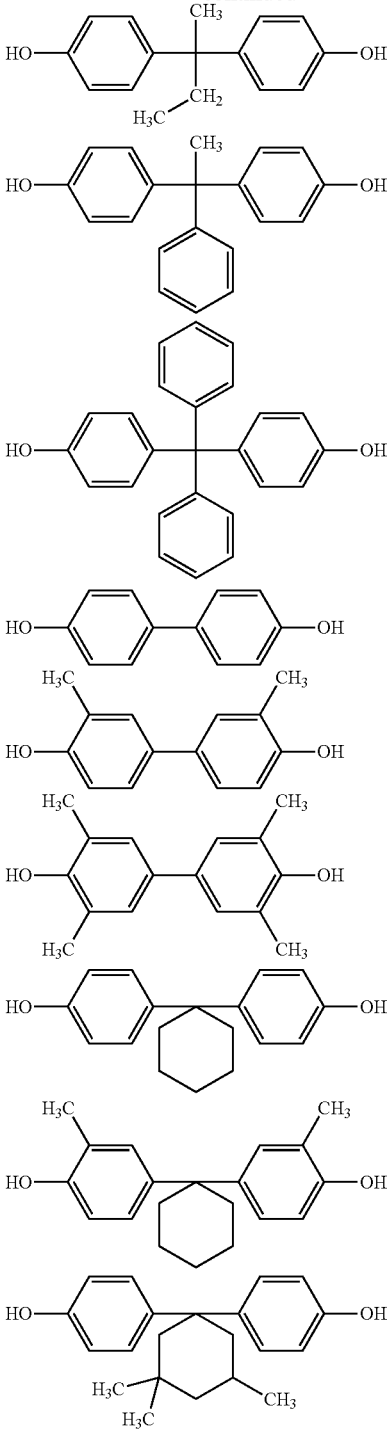
-continued
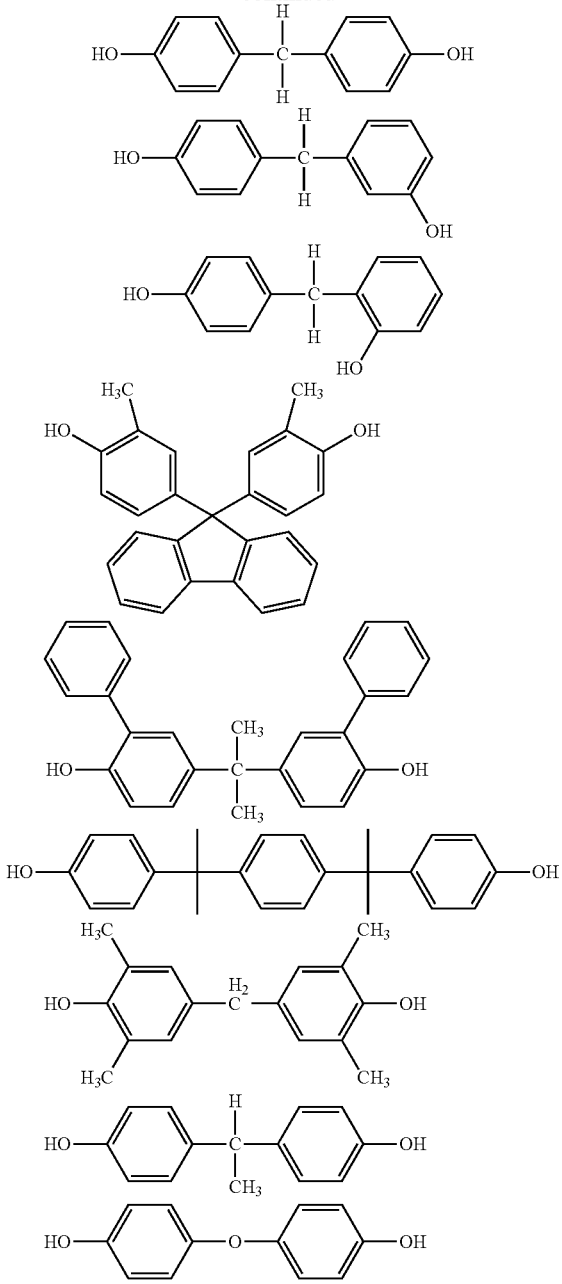
Specific examples of suitable structures of the binder resin are shown below. The following structures are mere examples, and any known binder resin may be used so long as the use thereof does not depart from the spirit of the invention.
[Chem. 9]
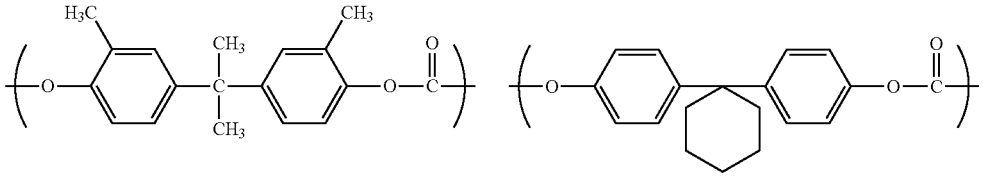

-continued

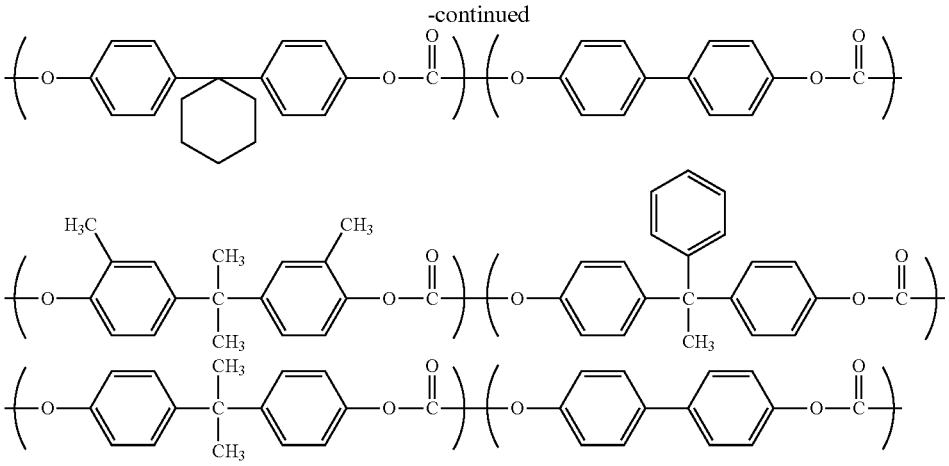

The binder resin to be used in the invention may have any desired viscosity-average molecular weight unless the effects of the invention are considerably lessened thereby. It is, however, desirable that the viscosity-average molecular weight thereof should be preferably 10,000 or higher, more preferably 20,000 or higher, and the upper limit thereof should be preferably 150,000 or less, more preferably 120,000 or less, even more preferably 100,000 or less. In case where the viscosity-average molecular weight thereof is too low, there is a possibility that the photoreceptor might have insufficient mechanical strength. In case where the viscosity-average molecular weight thereof is too high, there is a possibility that the coating fluid for photosensitive-layer formation might have too high a viscosity, resulting in a decrease in production efficiency.

With respect to the proportion of the binder resin to the charge transport substance, the charge transport substance is used in an amount of 10 parts by mass or larger per 100 parts by mass of the binder resin. In particular, the amount thereof is preferably 20 parts by mass or larger from the standpoint of lowering residual potential, and is more preferably 30 parts by mass or larger from the standpoints of stability in repeated use and of charge mobility.

Meanwhile, from the standpoint of the thermal stability of the photosensitive layer, the charge transport substance is used usually in an amount of 120 parts or less. In particular, the amount of the charge transport substance is preferably 100 parts by mass or less from the standpoint of compatibility between the charge transport material and the binder resin, more preferably 70 parts by mass or less from the standpoint of printing durability, and especially preferably 50 parts by mass or less from the standpoint of scratch resistance.

The thickness of the charge transport layer is not particularly limited. However, from the standpoints of long life and image stability and from the standpoint of charge stability, the thickness thereof is usually 5 μm or larger, preferably 10 μm or larger, and is usually 50 μm or less, preferably 45 μm or less, more preferably 40 μm or less. Especially suitable, from the standpoint of attaining an increase in resolution, is a thickness of 35 μm or less.

<Single-Layer Type Photosensitive Layer>

The single-layer type photosensitive layer is formed using a charge generation substance and a charge transport substance and further using a binder resin in order to ensure film strength as in the charge transport layer of the multilayer type photoreceptor. Specifically, the single-layer type photosensitive layer can be obtained by dissolving or dispersing a charge generation substance, a charge transport substance, and any of various binder resins in a solvent to produce a coating fluid, applying the coating fluid on an undercoat layer, and drying the coating fluid applied.

The kinds of the charge transport substance and binder resin and the ratio of these ingredients to be used may be the same as explained above with regard to the charge transport layer of the multilayer type photoreceptor. A charge generation substance is further dispersed in the charge transport medium constituted of the charge transport substance and binder resin.

As the charge generation substance, the same charge generation substances as those explained above with regard to the charge generation layer of the multilayer type photoreceptor can be used. In the case of the photosensitive layer of a single-layer type photoreceptor, however, it is necessary to regulate the charge generation substance so as to have a sufficiently reduced particle diameter. Specifically, the particle diameter of the charge generation substance is regulated to usually 1 μm or less, preferably 0.5 μm or less.

With respect to the ratio of the binder resin and charge generation substance used in the single-layer type photosensitive layer, the amount of the charge generation substance per 100 parts by mass of the binder resin is usually 0.1 part by mass or larger, preferably 1 part by mass or larger, and is usually 30 parts by mass or less, preferably 10 parts by mass or less.

The thickness of the single-layer type photosensitive layer is usually 5 μm or larger, preferably 10 μm or larger, and is usually 100 μm or less, preferably 50 μm or less.

<Other Functional Layers>

Known additives, e.g., an antioxidant, plasticizer, ultraviolet absorber, electron-attracting compound, leveling agent, and visible-light-shielding agent, may be incorporated into the photosensitive layer or each of the constituent layers thereof in either the multilayer type photoreceptor or the single-layer type photoreceptor, for the purpose of improving film-forming properties, flexibility, applicability, nonfouling properties, gas resistance, light resistance, etc.

In either the multilayer type photoreceptor or the single-layer type photoreceptor, the photosensitive layer formed in the manner described above may be an uppermost layer, i.e., a surface layer. It is, however, possible to further dispose another layer as a surface layer on the photosensitive layer. For example, a protective layer may be disposed for the purpose of preventing the photosensitive layer from being damaged or wearing or of preventing or lessening the deterioration of the photosensitive layer caused by, for example, discharge products released from the charging device, etc.

The protective layer is made to have an electrical resistance usually in the range of $10^9$-$10^{14}$ Ω·cm. In case where the electrical resistance thereof is higher than that range, the photoreceptor has an elevated residual potential to give fogged images. Meanwhile, in case where the electrical resistance thereof is lower than that range, the results are image blurring and a decrease in resolution. The protective layer must be configured so as not to substantially prevent the transmission of the light with which the photoreceptor is irradiated for imagewise exposure.

A fluororesin, silicone resin, polyethylene resin, or the like, particles of any of these resins, or particles of an inorganic compound may be incorporated into the surface layer for the purposes of reducing the frictional resistance and wear of the photoreceptor surface, heightening the efficiency of toner transfer from the photoreceptor to a transfer belt and to paper, etc. Alternatively, a layer which contains any of these resins or contains these particles may be newly formed as a surface layer.

[Cartridge and Image Forming Apparatus]

Figure 2:
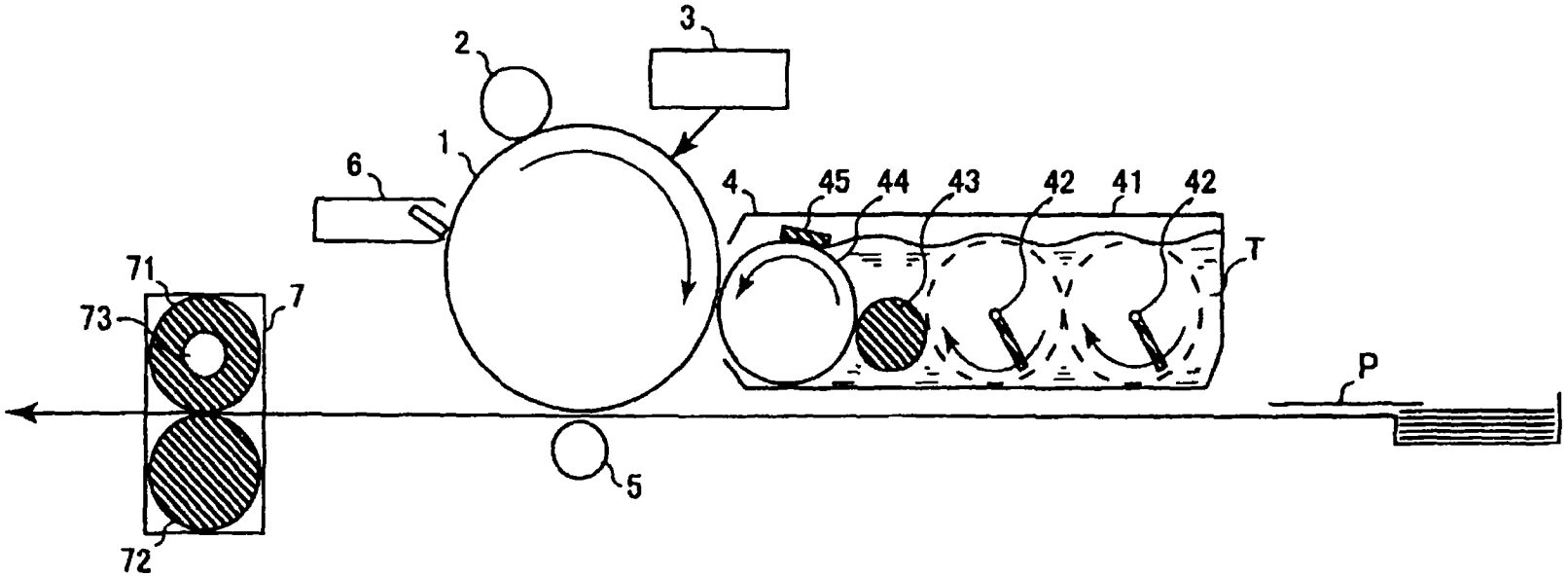
FIG. 2 is a diagrammatic view which illustrates the configuration of important portions of one embodiment of the image forming apparatus according to the invention.

Next, the drum cartridge and the image forming apparatus which employ either of the electrophotographic photoreceptors of the invention are explained on the basis of FIG. 2, which shows an embodiment of the apparatus.

In FIG. 2, numeral 1 denotes a drum-shaped photoreceptor, which is rotated in the direction of the arrow at a given peripheral speed. While the photoreceptor 1 is being rotated, the surface thereof is evenly charged to a positive or negative given potential by a charging means 2 and is then subjected, in an exposure part 3, to exposure for latent-image formation with an imagewise exposure means.

The electrostatic latent image formed is then developed with a toner by a developing means 4, and the developed toner image is successively transferred, by a corona transfer means 5, to a receiving object (paper, etc.) P supplied from a paper feed part. In FIG. 2, the developing means 4 includes a developing vessel 41, agitators 42, a feed roller 43, a developing roller 44, and a control member 45, and has been configured so that a toner T is retained in the developing vessel 41. According to need, the developing means 4 may be equipped with a replenishing device (not shown) for replenishing the toner T. This replenishing device is configured so that the toner T can be replenished from a container, e.g., a bottle or a cartridge.

The receiving object to which the image has been transferred is then sent to a fixing means 7, which fixes the image, and the printed receiving object is discharged from the apparatus. The fixing means 7 is configured of an upper fixing member (fixing roller) 71 and a lower fixing member (fixing roller) 72, and the fixing member 71 or 72 is equipped with a heater 73 inside. In FIG. 2 is shown an example in which the upper fixing member 71 is equipped with a heater 73 inside. As each of the upper and lower fixing members 71 and 72, use can be made of a known heat-fixing member such as a fixing roll obtained by coating a metallic tube made of stainless steel, aluminum, or the like with a silicone rubber, a fixing roll obtained by coating the metallic tube with a Teflon (registered trademark) resin, or a fixing sheet. Furthermore, the fixing members 71 and 72 may be configured so that a release agent such as a silicone oil is supplied thereto in order to improve release properties, or may be configured so that the two members are forcedly pressed against each other with springs or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P.

The surface of the photoreceptor 1 from which the image has been transferred is subjected to the action of a cleaning means 6 to remove the toner remaining untransferred, and is then subjected to charge neutralization with an erase means and is thereby cleaned in preparation for next image formation.

When the electrophotographic photoreceptor of the invention is used, the charging device to be used may be a direct charging means in which a direct charging member to which a voltage is being applied is brought into contact with the photoreceptor surface to charge the surface, besides being a corona charging device such as a corotron or a scorotron. Examples of the direct charging means include contact charging devices such as charging rollers and charging brushes. As a direct charging means, use can be made of either one which is accompanied with aerial discharge or injection charging which is not accompanied with aerial discharge. As the voltage to be applied for the charging, a direct-current voltage only can be used or an alternating current superimposed on a direct current is also usable.

For the exposure, use may be made of a halogen lamp, fluorescent lamp, laser (semiconductor or He—Ne), LED, internal photoreceptor exposure, etc. It is, however, preferred to use a digital electrophotographic technique employing a laser, LED, light shutter array, etc. With respect to wavelength, use can be made of monochromatic light having a slightly short wavelength in the range of 600-700 nm, besides monochromatic light of 780 nm.

In the development step, use may be made of a dry development technique, such a cascade development, development with a one-component insulated toner, development with a one-component conductive toner, or two-component magnetic-brush development, or a wet development technique or the like.

As the toner, use can be made of a chemical toner produced by suspension granulation, suspension polymerization, an emulsion polymerization aggregation method, etc., besides a toner produced by pulverization. In particular, in the case of chemical toners, ones having a small particle diameter of about 4-8 μm are used, and use can be made of toners of shapes ranging from a shape close to sphere to a shape which is not spherical, such as a potato shape. Polymerization toners are excellent in terms of evenness of charging and transferability and are suitable for image quality improvement.

In the transfer step, use may be made of an electrostatic transfer technique, pressure transfer technique, or adhesive transfer technique, such as corona transfer, roller transfer, or belt transfer. For the fixing, use may be made of hot-roller fixing, flash fixing, oven fixing, pressure fixing, IH fixing, belt fixing, IHF fixing, or the like. These fixing techniques may be used alone, or a plurality of fixing techniques may be used in combination.

For the cleaning, use may be made of a brush cleaner, magnetic brush cleaner, electrostatic brush cleaner, magnetic roller cleaner, blade cleaner, or the like.

The erase step is frequently omitted. In the case of conducting the step, use is made of a fluorescent lamp, LED, or the like. With respect to intensity, an exposure energy which is at least 3 times that of the exposure light is used in many cases. The apparatus may involve processes such as a pre-exposure step and an auxiliary charging step, besides those processes.

The cartridge employing an electrophotographic photoreceptor according to the invention is not limited so long as the cartridge is equipped with the photoreceptor 1 and at least one of the charging means 2, exposure part 3, developing means 4, and cleaning means 6.

In the invention, a plurality of members selected from constituent elements including the drum-shaped photoreceptor 1, charging means 2, developing means 4, and cleaning means 6 may be integrally combined together to constitute a drum cartridge, and this drum cartridge may be configured so that the cartridge can be mounted on and demounted from the main body of an electrophotographic apparatus, e.g., a copier or a laser beam printer. For example, at least one of the charging means 2, developing means 4, and cleaning means 6 can be made to be integrally supported together with the drum-shaped photoreceptor 1 to constitute a cartridge.

It is also possible to apply to an image forming apparatus equipped with an electrophotographic photoreceptor according to the invention, a charging means 2, an exposure part 3, a developing means 4, and a cleaning means 6.

EXAMPLES

The invention will be explained below in more detail by reference to Production Examples, Examples, and Comparative Examples. The following Examples are intended only for explaining the invention in detail, and the invention should not be construed as being limited to the following Examples unless the invention departs from the spirit thereof.

Production Example 1

Into a 5-L pressure vessel equipped with a stirrer, thermometer, torque meter, manometer, nitrogen gas introduction port, pressure regulator, and polymer discharge port were introduced 400.0 g of 12-aminododecanoic acid and 100.0 g of adipic acid. After the vessel was sufficiently subjected to nitrogen displacement, the contents were gradually heated while supplying nitrogen gas at a flow rate of 500 mL/min. Stirring was conducted at a speed of 50 rpm. The contents were heated from room temperature to 240° C. over 3 hours, and polymerization was conducted at 230° C. for 4 hours to synthesize a nylon-12 oligomer.

To this oligomer were added 1,500.0 g of polytetramethylene glycol (PolyTHF1800, manufactured by BASF A.G.), 2.0 g of tetrabutyl zirconate, and 5.0 g of an antioxidant (Tominox 917). After the inside of the vessel was sufficiently subjected to nitrogen displacement, the reaction mixture was gradually heated while supplying nitrogen gas at a flow rate of 500 mL/min. Stirring was conducted at a speed of 50 rpm. The mixture was heated from room temperature to 210° C. over 3 hours and heated at 210° C. for 3 hours. Subsequently, the pressure was gradually lowered to 50 Pa over 1 hour, and polymerization was conducted for 2 hours. Thereafter, heating and pressure reduction were conducted over 30 minutes, and polymerization was performed for 3 hours at 230° C. and about 30 Pa to complete the synthesis.

Subsequently, the stirring was stopped and nitrogen gas was supplied to the inside of the polymerization layer to return the pressure to ordinary pressure. Next, a colorless and transparent polymer in a molten state was discharged in a string form through the polymer discharge port, cooled with water, and then pelletized to obtain about 1.56 kg of pellets of polyamide resin I.

Production Example 2

Into a 5-L pressure vessel equipped with a stirrer, thermometer, torque meter, manometer, nitrogen gas introduction port, pressure regulator, and polymer discharge port were introduced 600.0 g of 12-aminododecanoic acid and 100.0 g of adipic acid. After the vessel was sufficiently subjected to nitrogen displacement, the contents were gradually heated while supplying nitrogen gas at a flow rate of 500 mL/min. Stirring was conducted at a speed of 50 rpm. The contents were heated from room temperature to 240° C. over 3 hours, and polymerization was conducted at 230° C. for 4 hours to synthesize a nylon-12 oligomer.

To this oligomer were added 1,800.0 g of polytetramethylene glycol (PolyTHF1800, manufactured by BASF A.G.), 2.0 g of tetrabutyl zirconate, and 5.0 g of an antioxidant (Tominox 917). After the inside of the vessel was sufficiently subjected to nitrogen displacement, the reaction mixture was gradually heated while supplying nitrogen gas at a flow rate of 500 mL/min. Stirring was conducted at a speed of 50 rpm. The mixture was heated from room temperature to 210° C. over 3 hours and heated at 210° C. for 3 hours. Subsequently, the pressure was gradually lowered to 50 Pa over 1 hour, and polymerization was conducted for 2 hours. Thereafter, heating and pressure reduction were conducted over 30 minutes, and polymerization was performed for 3 hours at 230° C. and about 30 Pa to complete the synthesis.

Subsequently, the stirring was stopped and nitrogen gas was supplied to the inside of the polymerization layer to return the pressure to ordinary pressure. Next, a colorless and transparent polymer in a molten state was discharged in a string form through the polymer discharge port, cooled with water, and then pelletized to obtain about 1.94 kg of pellets of polyamide resin II.

Production Example 3

Into a 5-L pressure vessel equipped with a stirrer, thermometer, torque meter, manometer, nitrogen gas introduction port, pressure regulator, and polymer discharge port were introduced 800.02 g of 12-aminododecanoic acid, 1,049.30 g of an XYX type triblock polyether diamine (XTJ-542, manufactured by HUNTSMAN Corp.; total amine, 1.95 meq/g), 150.68 g of adipic acid, 2.81 g of a 35.55% by mass aqueous solution of sodium hypophosphite, and 5.00 g of an antioxidant (Tominox 917). After the inside of the vessel was sufficiently subjected to nitrogen displacement, the contents were gradually heated while supplying nitrogen gas at a flow rate of 500 mL/min. Stirring was conducted at a speed of 50 rpm. The contents were heated from room temperature to 225° C. over 4 hours, and polymerization was conducted at 225° C. for 10 hours. Subsequently, the stirring was stopped, and a colorless and transparent polymer in a molten state was discharged in a string form through the polymer discharge port, cooled with water, and then pelletized to obtain about 1.68 kg of pellets of polyamide resin III.

Production Example 4

Into a 5-L pressure vessel equipped with a stirrer, thermometer, torque meter, manometer, nitrogen gas introduction port, pressure regulator, and polymer discharge port were introduced 490.0 g of 11-aminoundecanoic acid and 100.0 g of adipic acid. After the vessel was sufficiently subjected to nitrogen displacement, the contents were gradually heated while supplying nitrogen gas at a flow rate of 500 mL/min. Stirring was conducted at a speed of 50 rpm. The contents were heated from room temperature to 240° C. over 3 hours, and polymerization was conducted at 230° C. for 4 hours to synthesize a nylon-12 oligomer.

To this oligomer were added 1,800.0 g of polytetramethylene glycol (PolyTHF1800, manufactured by BASF A.G.), 2.0 g of tetrabutyl zirconate, and 5.0 g of an antioxidant (Tominox 917). After the inside of the vessel was sufficiently subjected to nitrogen displacement, the reaction mixture was gradually heated while supplying nitrogen gas at a flow rate of 500 mL/min. Stirring was conducted at a speed of 50 rpm. The mixture was heated from room temperature to 210° C. over 3 hours and heated at 210° C. for 3 hours. Subsequently, the pressure was gradually lowered to 50 Pa over 1 hour, and polymerization was conducted for 2 hours. Thereafter, heating and pressure reduction were conducted over 30 minutes, and polymerization was performed for 3 hours at 230° C. and about 30 Pa to complete the synthesis.

Subsequently, the stirring was stopped and nitrogen gas was supplied to the inside of the polymerization layer to return the pressure to ordinary pressure. Next, a colorless and transparent polymer in a molten state was discharged in a string form through the polymer discharge port, cooled with water, and then pelletized to obtain about 1.83 kg of pellets of polyamide resin IV.

The other polyamide resins used in the Examples or Comparative Examples are shown below.

Polyamide resin V: TPAE-32, manufactured by T&K TOKA Corp.

Polyamide resin VI: PA-100, manufactured by T&K TOKA Corp.

Polyamide resin VII: PA-200, manufactured by T&K TOKA Corp.

Polyamide resin VIII: PA-201, manufactured by T&K TOKA Corp.

Polyamide resin IX: FR-101, manufactured by Namariichi Co., Ltd.

Polyamide resin X: FR-301, manufactured by Namariichi Co., Ltd.

Polyamide resin XI: TXM-78A, manufactured by T&K TOKA Corp.

Polyamide resin XII: TXM-80A, manufactured by T&K TOKA Corp.

Polyamide resin XIII: copolymerized polyamide described in the Examples of JP-A-2011-170041

The blocks contained in the polyamide resins used in the Examples or Comparative Examples and whether a bond is present or absent therein are shown in Table 1. (○, present; ×, absent)

TABLE 1

| Polyamide resin | HS Polyamide block: Lactam | HS Polyamide block: Amino-carboxylic acid | HS Polyamide block: Diamine | SS Polyether block: PTMG | SS Polyether block: PPG | Dicarboxylic acid: Linear or branched di-carboxylic acid | Dicarboxylic acid: Polymerized fatty acid (C36 dimer acid) | Bond Ester bond |
|---|---|---|---|---|---|---|---|---|
| I | x | ○ (PA12) (20 wt %) | x | ○ (75 wt %) | x | ○ (5 wt %) | x | ○ |
| II | x | ○ (PA12) (22 wt %) | x | ○ (74 wt %) | x | ○ (4 wt %) | x | ○ |
| III | x | ○ (PA12) (41 wt %) | x | ○ (30 wt %) | ○ (24 wt %) | ○ (5 wt %) | x | x |
| IV | x | ○ (PA11) (21 wt %) | x | ○ (75 wt %) | x | ○ (4 wt %) | x | ○ |
| V | x | x | ○ | ○ | x | ○ | ○ | ○ |
| VI | x | x | ○ | x | x | x | ○ | x |
| VII | x | x | ○ | ○ | x | ○ | ○ | ○ |
| VIII | x | x | ○ | ○ | x | x | ○ | ○ |
| IX | x | ○ (PA6) | ○ | x | x | ○ | x | x |
| X | x | ○ (PA6/PA12) | ○ | x | x | ○ | x | x |
| XI | x | x | ○ | x | x | x | ○ | x |
| XII | x | x | ○ | x | x | x | ○ | x |
| XIII | ○ | x | ○ | x | x | ○ | x | x |

The degrees of elastic deformation of the polyamide resins used in the Examples are shown in Table 2. The values of the degree of elastic deformation were obtained through measurements made using the measuring method and measurement conditions described in this description.

TABLE 2

| Polyamide resin | Degree of elastic deformation of polyamide resin (%) |
|---|---|
| I | 72.5 |
| II | 71.7 |
| III | 57.5 |
| IV | 67.6 |
| V | 69.3 |
| VI | 47.3 |
| VII | 47.2 |
| VIII | 54.9 |
| IX | 54.2 |
| X | 36.1 |
| XI | 46.7 |
| XII | 45.7 |
| XIII | 23.1 |

Production of Photoreceptor Sheet

Example A-1

A photoreceptor sheet as one form of electrophotographic photoreceptors was produced in accordance with the following procedure. First, a dispersion for undercoat layer formation was produced in the following manner. Namely, rutile titanium oxide having an average primary-particle diameter of 40 nm ("TTO55N", manufactured by Ishihara Sangyo Kaisha, Ltd.) and methyldimethoxysilane ("TSL8117", manufactured by Toshiba Silicone Co., Ltd.), the amount of which was 3% by mass based on the titanium oxide, were introduced into a high-speed flow type mixer/kneader ("SMG300", manufactured by Kawata MFG Co., Ltd.) and mixed together at a high peripheral rotation speed of 34.5 m/sec to obtain a surface-treated titanium oxide. This surface-treated titanium oxide was dispersed in a methanol/1-propanol mixed solvent with a ball mill to thereby obtain a dispersion slurry of a hydrophobized titanium oxide.

The dispersion slurry, a methanol/1-propanol/toluene mixed solvent, and the polyamide resin I obtained in Production Example 1 were stirred and mixed, with stirring, to dissolve the polyamide resin. Thereafter, the mixture was subjected to an ultrasonic dispersion treatment, thereby obtaining a dispersion for undercoat layer formation in which the methanol/1-propanol/toluene mass ratio was 6/1/3 and which contained the hydrophobized titanium oxide and the polyamide resin I in a former/latter mass ratio of 3/1 and had a solid concentration of 18.0% by mass.

solution of poly(vinyl butyral) (trade name #6000C, manufactured by Denki Kagaku Kogyo K.K.). An appropriate amount of 1,2-dimethoxyethane was added thereto to finally produce a coating fluid for charge generation layer formation which had a solid concentration of 4.0% by mass.

This coating fluid for charge generation layer formation was applied to the undercoat layer with a wire-wound bar in such an amount as to result in a dry film thickness of 0.4 μm, and then dried to form a charge generation layer.

Next, 50 parts by mass of a mixture of geometrical isomer compounds that was shown in the Example 1 of JP-A-2002-80432, which had the structure represented by the following formula CTM-1 as a main component, as a charge transport substance, 100 parts by mass of a polyarylate A (viscosity-average molecular weight, 41,000) made up of the repeating structure represented by the following formula PAR-A, and 0.05 parts by mass of a silicone oil as a leveling agent were mixed with 640 parts by mass of a tetrahydrofuran/toluene mixed solvent (tetrahydrofuran, 80% by mass; toluene, 20% by mass) to prepare a coating fluid for charge transport layer formation.

[Chem. 10]

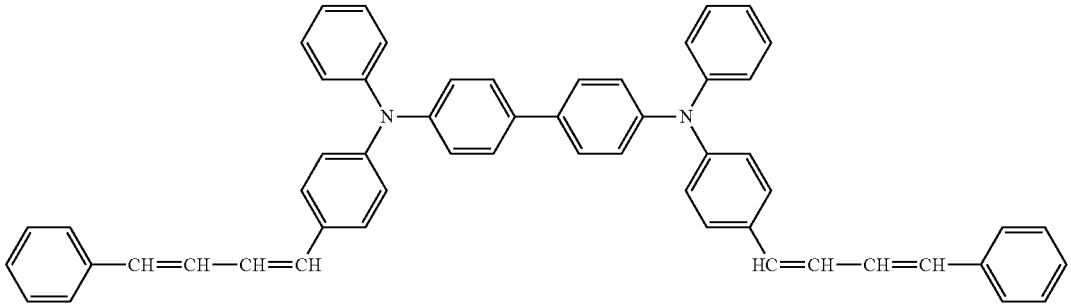

CTM-1

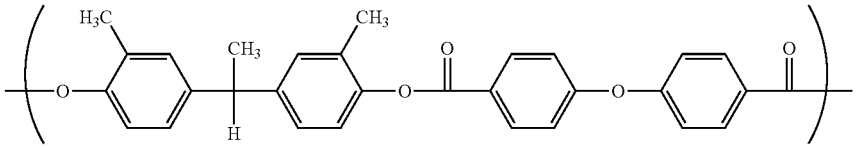

PAR-A

The dispersion for undercoat layer formation thus obtained was applied to a poly(ethylene terephthalate) film which had a surface coated with vapor-deposited aluminum and which had a thickness of 75 μm, with a wire-wound bar in such an amount as to result in a dry film thickness of 1.5 μm. The dispersion applied was dried to form an undercoat layer.

Figure 3:
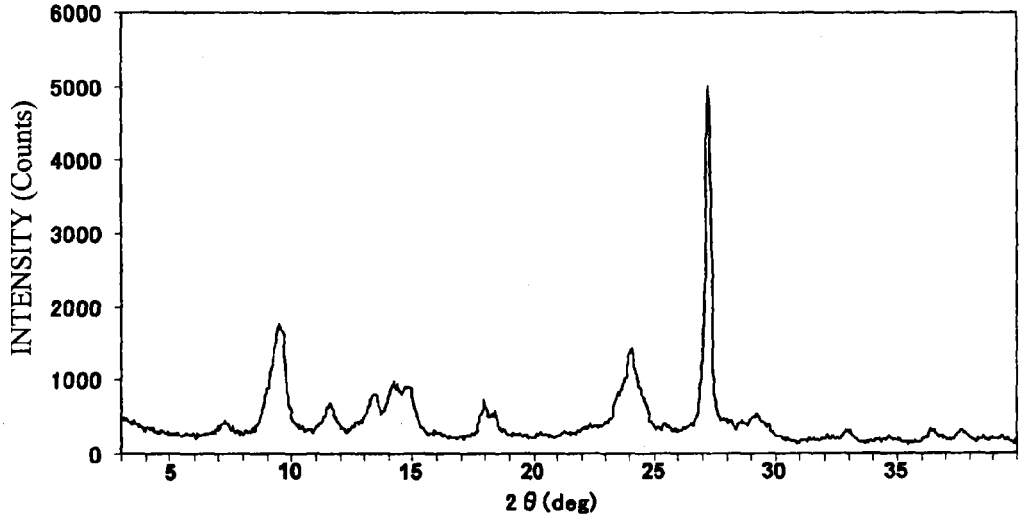
FIG. 3 is a chart which shows X-ray diffraction peaks for the titanyl phthalocyanine pigment used in the Examples, the peaks being observed using CuKα as a radiation source.

Subsequently, 10 parts by mass of oxytitanium phthalocyanine showing an intense diffraction peak at a Bragg angle)(2θ±0.2° of 27.3° in X-ray diffractometry with a CuKα line and having the X-ray powder diffraction spectrum shown in FIG. 3 was added to 150 parts by mass of 1,2-dimethoxyethane. This mixture was subjected to a pulverization/dispersion treatment with a grinding sand mill to produce a pigment dispersion. The pigment dispersion thus obtained in an amount of 160 parts by mass was added to 100 parts by mass of a 5% by mass 1,2-dimethoxyethane This coating fluid for charge transport layer formation was applied to the charge generation layer with an applicator in such an amount as to result in a dry film thickness of 25 μm, and dried at 125° C. for 20 minutes to form a charge transport layer. Thus, a photoreceptor sheet SE1 was produced.

<Evaluation of Electrical Properties of the Photoreceptor>

An apparatus for electrophotographic-property evaluation produced in accordance with the measurement standards of The Society of Electrophotography of Japan (described in The Society of Electrophotography of Japan, ed., *Zoku Denshi Shashin Gijutsu No Kiso To Õyõ*, Corona Publishing Co., Ltd., pp. 404-405) was used. The photoreceptor was adhered to the aluminum drum and thereby formed into a cylindrical shape. The aluminum drum was electrically connected to the aluminum support of the photoreceptor. Thereafter, the drum was rotated at a constant rotation speed to conduct a test for evaluating electrical properties through cycling which included charging, exposure, potential measurement, and erase.

In the test, the initial surface potential was regulated to −700 V, and monochromatic light of 780 nm and monochromatic light of 660 nm were used for exposure and erase, respectively. The surface potential (VL) at the time when the photoreceptor had been irradiated with 780-nm light in an amount of 1.0 μJ/cm$^2$ was measured, and the exposure amount (half-decay exposure) required for the surface potential to become half, i.e., −350 V, was measured as an index to sensitivity. For the VL measurement, the time period from the exposure to the potential measurement was set at 100 ms. The measurement was made in an atmosphere having a temperature of 25° C. and a relative humidity of 50%. The smaller the value of sensitivity (half-decay exposure) and the smaller the absolute value of VL, the better the electrical properties. The results of the electrical properties are shown in Table 3.

Production of Photoreceptor for Adhesion Test

Example B-1

A photoreceptor PE1 for adhesion test was produced in the same manner as in Example A-1, except that an aluminum sheet having a thickness of 0.5 mm was used in place of the aluminum-coated poly(ethylene terephthalate) film used in <Production of Photoreceptor Sheet> in Example A-1.

<Adhesion Test>

Using an NT cutter, any portion of the surface of the photoreceptor for adhesion test was incised at intervals of 5 mm to make three incisions in the length direction and four incisions in the width direction, thereby forming 2×3, i.e., 6, squares. Cello Tape (registered trademark) (manufactured by Nichiban Co., Ltd.) was applied to the incised surface and pulled up at an angle of 90° with the adherend surface. Thus, the adhesion of the photosensitive layer was tested. The same test was performed in five portions, and the proportion in number of photosensitive-layer squares remaining on the support to the 30 squares in total was evaluated as percentage remaining.

The larger the number of remaining squares, the higher the percentage remaining and the better the adhesion. The results are shown in Table 4.

Example A-2 and Example B-2

A photoreceptor sheet SE2 (Example A-2) and a photoreceptor PE2 for adhesion test (Example B-2) were produced in the same manners as in Example A-1 and Example B-1, respectively, except that a polyarylate B (PAR-B) made up of the following repeating structure was used in an amount of 100 parts by mass in place of the polyarylate A (PAR-A) used as a binder resin in the coating fluid for charge transport layer formation of Example A-1 and Example B-1. These photoreceptors were evaluated in the same manners as in Example A-1 and Example B-1. The results thereof are shown in Table 3 and Table 4.

[Chem. 11]

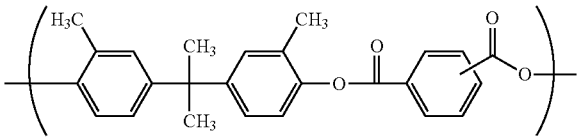

PAR-B

Example A-3 and Example B-3

A photoreceptor sheet SE3 (Example A-3) and a photoreceptor PE3 for adhesion test (Example B-3) were produced in the same manners as in Example A-1 and Example B-1, respectively, except that a polyarylate C (PAR-C) made up of the following repeating structure was used in an amount of 100 parts by mass in place of the polyarylate A (PAR-A) used as a binder resin in the coating fluid for charge transport layer formation of Example A-1 and Example B-1. These photoreceptors were evaluated in the same manners as in Example A-1 and Example B-1. The results thereof are shown in Table 3 and Table 4.

[Chem. 12]

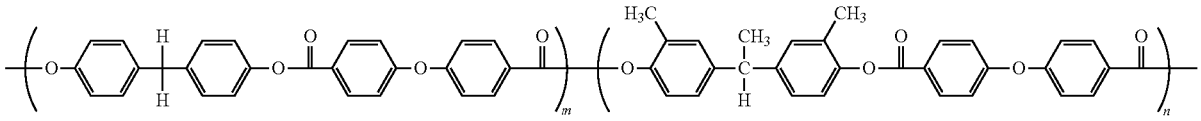

PAR-C m:n = 60:40

Example A-4 and Example B-4

A photoreceptor sheet SE4 (Example A-4) and a photoreceptor PE4 for adhesion test (Example B-4) were produced in the same manners as in Example A-3 and Example B-3, respectively, except that the mixture of geometrical isomer compounds shown in the Production Example 4 of JP-A-2009-20504, which had the structure represented by the following formula (CTM-2) as a main component, was used in an amount of 50 parts by mass as a charge transport substance in place of the charge transport substance CTM-1 used in Example A-3 and Example B-3. These photoreceptors were evaluated in the same manners as in Example A-1 and Example B-1. The results thereof are shown in Table 3 and Table 4.

[Chem. 13]

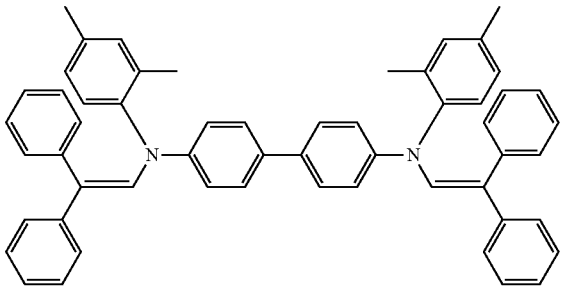

CTM-2

Example A-5 and Example B-5

A photoreceptor sheet SE5 (Example A-5) and a photoreceptor PE5 for adhesion test (Example B-5) were produced in the same manners as in Example A-1 and Example B-1, respectively, except that polyamide resin II was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Example A-6 and Example B-6

A photoreceptor sheet SE6 (Example A-6) and a photoreceptor PE6 for adhesion test (Example B-6) were produced in the same manners as in Example A-4 and Example B-4, respectively, except that polyamide resin II was used in place of the polyamide resin I used in the dispersion for undercoat layer formation of Example A-4 and Example B-4. These photoreceptors were evaluated in the same manners as in Example A-1 and Example B-1. The results thereof are shown in Table 3 and Table 4.

Example A-7 and Example B-7

A photoreceptor sheet SE7 (Example A-7) and a photoreceptor PE7 for adhesion test (Example B-7) were produced in the same manners as in Example A-1 and Example B-1, respectively, except that polyamide resin III was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Example A-8 and Example B-8

A photoreceptor sheet SE8 (Example A-8) and a photoreceptor PE8 for adhesion test (Example B-8) were produced in the same manners as in Example A-4 and Example B-4, respectively, except that polyamide resin III was used in place of the polyamide resin I used in the dispersion for undercoat layer formation of Example A-4 and Example B-4. These photoreceptors were evaluated in the same manners as in Example A-1 and Example B-1. The results thereof are shown in Table 3 and Table 4.

Example A-9 and Example B-9

A photoreceptor sheet SE9 (Example A-9) and a photoreceptor PE9 for adhesion test (Example B-9) were produced in the same manners as in Example A-1 and Example B-1, respectively, except that polyamide resin IV was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Example A-10 and Example B-10

A photoreceptor sheet SE10 (Example A-10) and a photoreceptor PE10 for adhesion test (Example B-10) were produced in the same manners as in Example A-4 and Example B-4, respectively, except that polyamide resin IV was used in place of the polyamide resin I used in the dispersion for undercoat layer formation of Example A-4 and Example B-4. These photoreceptors were evaluated in the same manners as in Example A-1 and Example B-1. The results thereof are shown in Table 3 and Table 4.

Example A-11 and Example B-11

A photoreceptor sheet SE6 (Example A-11) and a photoreceptor PE11 for adhesion test (Example B-11) were produced in the same manners as in Example A-1 and Example B-1, except that polyamide resin III was blended with polyamide resin XII in a mass ratio of 1/3 and this mixture was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Example A-12 and Example B-12

A photoreceptor sheet SE12 (Example A-12) and a photoreceptor PE12 for adhesion test (Example B-12) were produced in the same manners as in Example A-1 and Example B-1, except that polyamide resin V was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Example A-13 and Example B-13

A photoreceptor sheet SE13 (Example A-13) and a photoreceptor PE13 for adhesion test (Example B-13) were produced in the same manners as in Example A-4 and Example B-4, except that polyamide resin V was used in place of the polyamide resin I used in the dispersion for undercoat layer formation of Example A-4 and Example B-4. These photoreceptors were evaluated in the same manners as in Example A-1 and Example B-1. The results thereof are shown in Table 3 and Table 4.

Comparative Example A-1 and Comparative Example B-1

A photoreceptor sheet SP1 (Comparative Example A-1) and a photoreceptor PP1 for adhesion test (Comparative Example B-1) were produced in the same manners as in Example A-1 and Example B-1, except that polyamide resin VI was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-2 and Comparative Example B-2

A photoreceptor sheet SP2 (Comparative Example A-2) and a photoreceptor PP2 for adhesion test (Comparative Example B-2) were produced in the same manners as in Example A-1 and Example B-1, except that polyamide resin VII was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-3 and Comparative Example B-3

A photoreceptor sheet SP3 (Comparative Example A-3) and a photoreceptor PP3 for adhesion test (Comparative Example B-3) were produced in the same manners as in Example A-1 and Example B-1, except that polyamide resin VIII was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-4 and Comparative Example B-4

A photoreceptor sheet SP4 (Comparative Example A-4) and a photoreceptor PP4 for adhesion test (Comparative Example B-4) were produced in the same manners as in Example A-4 and Example B-4, except that polyamide resin VIII was used in place of the polyamide resin I used in the dispersion for undercoat layer formation of Example A-4 and Example B-4. These photoreceptors were evaluated in the same manners as in Example A-1 and Example B-1. The results thereof are shown in Table 3 and Table 4.

Comparative Example A-5 and Comparative Example B-5

A photoreceptor sheet SP5 (Comparative Example A-5) and a photoreceptor PP5 for adhesion test (Comparative Example B-5) were produced in the same manners as in Example A-1 and Example B-1, except that polyamide resin IX was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-6 and Comparative Example B-6

A photoreceptor sheet SP6 (Comparative Example A-6) and a photoreceptor PP6 for adhesion test (Comparative Example B-6) were produced in the same manners as in Example A-1 and Example B-1, except that polyamide resin X was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-7 and Comparative Example B-7

A photoreceptor sheet SP7 (Comparative Example A-7) and a photoreceptor PP7 for adhesion test (Comparative Example B-7) were produced in the same manners as in Example A-1 and Example B-1, except that polyamide resin XI was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-8 and Comparative Example B-8

A photoreceptor sheet SP8 (Comparative Example A-8) and a photoreceptor PP8 for adhesion test (Comparative Example B-8) were produced in the same manners as in Example A-1 and Example B-1, except that polyamide resin XII was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-9 and Comparative Example B-9

A photoreceptor sheet SP9 (Comparative Example A-9) and a photoreceptor PP9 for adhesion test (Comparative Example B-9) were produced in the same manners as in Example A-1 and Example B-1, except that polyamide resin XIII was used in place of the polyamide resin I used in the dispersion for undercoat layer formation of Example A-1 and Example B-1. These photoreceptors were evaluated in the same manners as in Example A-1 and Example B-1. The results thereof are shown in Table 3 and Table 4.

Comparative Example A-10 and Comparative Example B-10

A photoreceptor sheet SP10 (Comparative Example A-10) and a photoreceptor PP10 for adhesion test (Comparative Example B-10) were produced in the same manners as in Example A-2 and Example B-2, except that polyamide resin XIII was used in place of the polyamide resin I used in the dispersion for undercoat layer formation of Example A-2 and Example B-2. These photoreceptors were evaluated in the same manners as in Example A-1 and Example B-1. The results thereof are shown in Table 3 and Table 4.

Comparative Example A-11 and Comparative Example B-11

A photoreceptor sheet SP11 (Comparative Example A-11) and a photoreceptor PP11 for adhesion test (Comparative Example B-11) were produced in the same manners as in Example A-3 and Example B-3, except that polyamide resin XIII was used in place of the polyamide resin I used in the dispersion for undercoat layer formation of Example A-3 and Example B-3. These photoreceptors were evaluated in the same manners as in Example A-1 and Example B-1. The results thereof are shown in Table 3 and Table 4.

Comparative Example A-12 and Comparative Example B-12

A photoreceptor sheet SP12 (Comparative Example A-12) and a photoreceptor PP12 for adhesion test (Comparative Example B-12) were produced in the same manners as in Example A-4 and Example B-4, except that polyamide resin XIII was used in place of the polyamide resin I used in the dispersion for undercoat layer formation of Example A-4 and Example B-4. These photoreceptors were evaluated in the same manners as in Example A-1 and Example B-1. The results thereof are shown in Table 3 and Table 4.

Example A-1, Example A-5, Example A-7, and Example A-9 in Table 3 each have a smaller absolute value of surface potential (VL) than Comparative Example A-3 and show satisfactory electrical properties. This is thought to be because the polyamide blocks contained in the polyamide resins used in Example A-1, Example A-5, Example A-7, and Example A-9 have been configured by the polymerization of an aminocarboxylic acid and a linear dicarboxylic acid.

The polyamide block contained in the polyamide resin used in Comparative Example A-3 contains neither a lactam nor an aminocarboxylic acid. It is thought that the terminal amino group or terminal carboxyl group which remained unreacted in the polymerization of a diamine and a dicarboxylic acid has exerted an influence to bring about the deterioration in electrical property.

Comparative Example A-8 shows considerably deteriorated electrical properties, among the photoreceptor sheets which were able to be produced and evaluated. This is thought to be because the polyamide resin used in Comparative Example A-8 contains neither a lactam nor an aminocarboxylic acid and has a terminal carboxyl group, resulting in electrical polarization.

TABLE 3

| | Photo-receptor No. | Polyamide resin | Proportion of PE in under-coat layer (wt %) | Resin in photo-sensitive layer | Sensitivity/ Half-decay exposure (μJ/cm$^2$) | VL (-V) | Remarks |
|---|---|---|---|---|---|---|---|
| Example A-1 | SE1 | I | 18.8 | PAR-A | 0.112 | 116 | |
| Example A-2 | SE2 | I | 18.8 | PAR-B | 0.112 | 117 | |
| Example A-3 | SE3 | I | 18.8 | PAR-C | 0.115 | 106 | |
| Example A-4 | SE4 | I | 18.8 | PAR-C | 0.106 | 84 | |
| Example A-5 | SE5 | II | 18.5 | PAR-A | 0.107 | 98 | |
| Example A-6 | SE6 | II | 18.5 | PAR-C | 0.103 | 70 | |
| Example A-7 | SE7 | III | 14.1 | PAR-A | 0.097 | 83 | |
| Example A-8 | SE8 | III | 14.1 | PAR-C | 0.097 | 68 | |
| Example A-9 | SE9 | IV | 18.8 | PAR-A | 0.114 | 95 | |
| Example A-10 | SE10 | IV | 18.8 | PAR-C | 0.105 | 71 | |
| Example A-11 | SE11 | III/XIII | 3.5 | PAR-A | 0.105 | 104 | |
| Example A-12 | SE12 | V | 0< | PAR-A | 0.107 | 153 | |
| Example A-13 | SE13 | V | 0< | PAR-C | 0.113 | 163 | |
| Comparative Example A-1 | SP1 | VI | 0 | PAR-A | 0.106 | 207 | |
| Comparative Example A-2 | SP2 | VII | 0 | PAR-A | 0.115 | 211 | |
| Comparative Example A-3 | SP3 | VIII | 0< | PAR-A | 0.109 | 136 | |
| Comparative Example A-4 | SP4 | VIII | 0< | PAR-C | 0.113 | 145 | |
| Comparative Example A-5 | SP5 | IX | 0 | PAR-A | 0.078 | 123 | |
| Comparative Example A-6 | SP6 | X | 0 | PAR-A | 0.091 | 90 | |
| Comparative Example A-7 | SP7 | XI | 0 | PAR-A | — | — | unable to be evaluated (fluid for undercoat layer was unable to be prepared) |
| Comparative Example A-8 | SP8 | XII | 0 | PAR-A | 0.135 | 307 | |
| Comparative Example A-9 | SP9 | XIII | 0 | PAR-A | 0.093 | 89 | |
| Comparative Example A-10 | SP10 | XIII | 0 | PAR-B | 0.095 | 90 | |
| Comparative Example A-11 | SP11 | XIII | 0 | PAR-C | 0.093 | 79 | |
| Comparative Example A-12 | SP12 | XIII | 0 | PAR-C | — | — | unable to be evaluated (peeling of photosensitive layer) |

TABLE 4

| | Photo-receptor No. | Polyamide resin | Proportion of PE in under-coat layer (wt %) | Resin in photo-sensitive layer | Charge transport substance in photo-sensitive layer | Adhesion/ Percentage remaining (%) | Remarks |
|---|---|---|---|---|---|---|---|
| Example B-1 | PE1 | I | 18.8 | PAR-A | CTM-1 | 100 | |
| Example B-2 | PE2 | I | 18.8 | PAR-B | CTM-1 | 100 | |
| Example B-3 | PE3 | I | 18.8 | PAR-C | CTM-1 | 100 | |
| Example B-4 | PE4 | I | 18.8 | PAR-C | CTM-2 | 100 | |
| Example B-5 | PE5 | II | 18.5 | PAR-A | CTM-1 | 100 | |
| Example B-6 | PE6 | II | 18.5 | PAR-C | CTM-2 | 100 | |
| Example B-7 | PE7 | III | 14.1 | PAR-A | CTM-1 | 100 | |
| Example B-8 | PE8 | III | 14.1 | PAR-C | CTM-2 | 0 | peeling at charge transport layer |
| Example B-9 | PE9 | IV | 18.8 | PAR-A | CTM-1 | 100 | |
| Example B-10 | PE10 | IV | 18.8 | PAR-C | CTM-2 | 100 | |
| Example B-11 | PE11 | III/XIII | 3.5 | PAR-A | CTM-1 | 83.3 | |
| Example B-12 | PE12 | V | 0< | PAR-A | CTM-1 | 100 | |
| Example B-13 | PE13 | V | 0< | PAR-C | CTM-2 | 66.7 | |
| Comparative Example B-1 | PP1 | VI | 0 | PAR-A | CTM-1 | 0 | |
| Comparative Example B-2 | PP2 | VII | 0 | PAR-A | CTM-1 | 0 | |
| Comparative Example B-3 | PP3 | VIII | 0< | PAR-A | CTM-1 | 100 | |
| Comparative Example B-4 | PP4 | VIII | 0< | PAR-C | CTM-2 | 0 | peeling at base |
| Comparative Example B-5 | PP5 | IX | 0 | PAR-A | CTM-1 | 0 | |
| Comparative Example B-6 | PP6 | X | 0 | PAR-A | CTM-1 | 0 | |
| Comparative Example B-7 | PP7 | XI | 0 | PAR-A | CTM-1 | — | unable to be evaluated |
| Comparative Example B-8 | PP8 | XII | 0 | PAR-A | CTM-1 | 0 | |
| Comparative Example B-9 | PP9 | XIII | 0 | PAR-A | CTM-1 | 0 | |
| Comparative Example B-10 | PP10 | XIII | 0 | PAR-B | CTM-1 | 0 | |
| Comparative Example B-11 | PP11 | XIII | 0 | PAR-C | CTM-1 | 0 | |
| Comparative Example B-12 | PP12 | XIII | 0 | PAR-C | CTM-2 | 0 | |

It can be seen from the results given in Table 4 that adhesion is remarkably improved by using the polyamide resins according to the invention in the undercoat layers. Furthermore, in cases when the polyamide resins in which the HS and SS in the block copolymer have been bonded to each other by an ester bond are used in the undercoat layers, adhesion to less bondable photosensitive layers can be improved.

In Comparative Example B-12, the photosensitive layer employed a combination of a polyarylate resin (PAR-C) and a charge transport substance (CTM-2) and had a composition which was susceptible to peeling off. Comparative Example B-12 hence showed exceedingly poor adhesion between the photosensitive layer and the photosensitive layer, and it was ascertained that the photosensitive layer had lifted off just after the drying. With respect to Comparative Example B-4, it was ascertained that separation had occurred between the base and the undercoat layer.

Meanwhile, it can be seen that in Example B-4, Example B-6, and Example B-8, the photosensitive layers showed remarkably improved adhesion although these Examples employed the composition susceptible to peeling off. It can also be seen that the larger the amount of the polyether block contained in the undercoat layer, the better the adhesion. In Example B-8, although the percentage remaining was 0, the separation had occurred at the charge transport layer and adhesion between the undercoat layer and each of the base and charge generation layer which adjoined the undercoat layer was able to ascertained. Namely, Example B-8 gave results different from those of Comparative Example B-4.

It can be seen from the results given in Table 3 and Table 4 that the photoreceptors within the scope of the invention stably show satisfactory electrical properties and retain highly satisfactory adhesion. Meanwhile, in the photoreceptor outside the scope of the invention, there are cases where the electrical properties thereof deteriorate. This is thought to be attributable to a deterioration in adhesion or to a difference in the polymer components of the undercoat layer.

Example B-14

A photoreceptor PEC1 for adhesion test was produced in the same manner as in Example B-1, except that a polycarbonate D (PCR-D) made up of the following repeating structures was used in an amount of 100 parts by mass in place of the polyarylate A (PAR-A) used as a binder resin in the coating fluid for charge transport layer formation of Example B-1. These photoreceptors were evaluated in the same manner as in Example B-1, and the results thereof are shown in Table 5.

[Chem. 14]

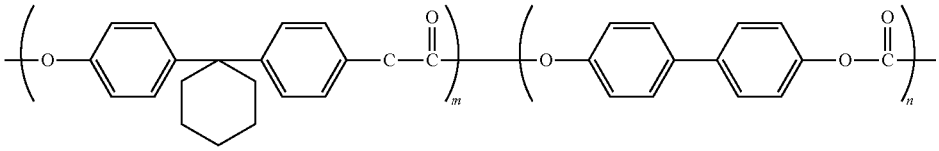

PCR-D m:n = 90:10

Example B-15

A photoreceptor PEC2 for adhesion test was produced in the same manner as in Example B-14, except that polyamide resin II was used in place of the polyamide resin I used in the dispersion for undercoat layer formation of Example B-14. These photoreceptors were evaluated in the same manner as in Example B-1, and the results thereof are shown in Table 5.

Example B-16

A photoreceptor PEC3 for adhesion test was produced in the same manner as in Example B-14, except that polyamide resin III was used in place of the polyamide resin I used in the dispersion for undercoat layer formation of Example B-14. These photoreceptors were evaluated in the same manner as in Example B-1, and the results thereof are shown in Table 5.

Example B-17

A photoreceptor PEC4 for adhesion test was produced in the same manner as in Example B-14, except that polyamide resin V was used in place of the polyamide resin I used in the dispersion for undercoat layer formation of Example B-14. These photoreceptors were evaluated in the same manner as in Example B-1, and the results thereof are shown in Table 5.

Comparative Example B-13

A photoreceptor PPC1 for adhesion test was produced in the same manner as in Example B-14, except that polyamide resin VI was used in place of the polyamide resin I used in the dispersion for undercoat layer formation of Example B-14. These photoreceptors were evaluated in the same manner as in Example B-1, and the results thereof are shown in Table 5.

Comparative Example B-14

A photoreceptor PPC2 for adhesion test was produced in the same manner as in Example B-14, except that polyamide resin VII was used in place of the polyamide resin I used in the dispersion for undercoat layer formation of Example B-14. These photoreceptors were evaluated in the same manner as in Example B-1, and the results thereof are shown in Table 5.

Comparative Example B-15

A photoreceptor PPC3 for adhesion test was produced in the same manner as in Example B-14, except that polyamide resin IX was used in place of the polyamide resin I used in the dispersion for undercoat layer formation of Example B-14. These photoreceptors were evaluated in the same manner as in Example B-1, and the results thereof are shown in Table 5.

Comparative Example B-16

A photoreceptor PPC4 for adhesion test was produced in the same manner as in Example B-14, except that polyamide resin X was used in place of the polyamide resin I used in the dispersion for undercoat layer formation of Example B-14. These photoreceptors were evaluated in the same manner as in Example B-1, and the results thereof are shown in Table 5.

Comparative Example B-17

A photoreceptor PPC5 for adhesion test was produced in the same manner as in Example B-14, except that polyamide resin XIII was used in place of the polyamide resin I used in the dispersion for undercoat layer formation of Example B-14. These photoreceptors were evaluated in the same manner as in Example B-1, and the results thereof are shown in Table 5.

TABLE 5

| | Photo-receptor No. | Polyamide resin | Proportion of PE in under-coat layer (wt %) | Resin in photo-sensitive layer | Charge transport substance in photo-sensitive layer | Adhesion/ Percentage remaining (%) |
|---|---|---|---|---|---|---|
| Example B-14 | PEC1 | I | 18.8 | PCR-D | CTM-1 | 75 |
| Example B-15 | PEC2 | II | 18.8 | PCR-D | CTM-1 | 73 |
| Example B-16 | PEC3 | III | 18.8 | PCR-D | CTM-1 | 67 |
| Example B-17 | PEC4 | V | 18.8 | PCR-D | CTM-1 | 70 |

TABLE 5-continued

| | Photo-receptor No. | Polyamide resin | Proportion of PE in under-coat layer (wt %) | Resin in photo-sensitive layer | Charge transport substance in photo-sensitive layer | Adhesion/ Percentage remaining (%) |
|---|---|---|---|---|---|---|
| Comparative Example B-13 | PPC1 | VI | 0 | PCR-D | CTM-1 | 0 |
| Comparative Example B-14 | PPC2 | VII | 0 | PCR-D | CTM-1 | 0 |
| Comparative Example B-15 | PPC3 | IX | 0 | PCR-D | CTM-1 | 0 |
| Comparative Example B-16 | PPC4 | X | 0 | PCR-D | CTM-1 | 0 |
| Comparative Example B-17 | PPC5 | XIII | 0 | PCR-D | CTM-1 | 0 |

Example A-18 and Example B-18

A photoreceptor sheet SE14 (Example A-18) and a photoreceptor PE14 for adhesion test (Example B-18) were produced in the same manners as in Example A-5 and Example B-5, except that a coating fluid for undercoat layer formation produced without using the hydrophobized titanium oxide used in Example A-5 and Example B-5 was used in place of the dispersion for undercoat layer formation of Example A-5 and Example B-5, and that the thickness of the undercoat layer was changed to 0.1 μm. These photoreceptors were evaluated in the same manners as in Example A-1 and Example B-1. The results thereof are shown in Table 6 and Table 7.

Example A-19 and Example B-19

A photoreceptor sheet SE15 (Example A-19) and a photoreceptor PE15 for adhesion test (Example B-19) were produced in the same manners as in Example A-7 and Example B-7, except that a coating fluid for undercoat layer formation produced without using the hydrophobized titanium oxide used in Example A-7 and Example B-7 was used in place of the dispersion for undercoat layer formation of Example A-7 and Example B-7, and that the thickness of the undercoat layer was changed to 0.1 These photoreceptors were evaluated in the same manners as in Example A-1 and Example B-1. The results thereof are shown in Table 6 and Table 7.

TABLE 6

| | Photoreceptor No. | Sensitivity/Half-decay exposure (μJ/cm$^2$) | VL (−V) |
|---|---|---|---|
| Example A-18 | SE14 | 0.138 | 194 |
| Example A-19 | SE15 | 0.128 | 184 |

TABLE 7

| | Photo-receptor No. | Polyamide resin | Proportion of PE in under-coat layer (wt %) | Resin in photo-sensitive layer | Charge transport substance in photo-sensitive layer | Adhesion/ Percentage remaining (%) |
|---|---|---|---|---|---|---|
| Example B-18 | PE14 | II | 74 | PAR-A | CTM-1 | 100 |
| Example B-19 | PE15 | III | 56.3 | PAR-A | CTM-1 | 100 |

Production of Photoreceptor Drum

Example A-20

The coating fluid for undercoat layer formation, coating fluid for charge generation layer formation, and coating fluid for charge transport layer formation which had been used in Example A-1 were successively applied by dip coating on an aluminum cylinder in which the surface had been mirror-finished and which had an outer diameter of 30 mm, length of 260.5 μm, and wall thickness of 0.75 mm, in such amounts as to result in dry film thicknesses of 1.5 μm, 0.4 μm, and 21 μm, respectively. Thus, an undercoat layer, a charge generation layer, and a charge transport layer were formed to obtain a photoreceptor drum DE1.

[Image Characteristics Test]

Here, the photoreceptor drum produced was used to conduct an image characteristics test.

The image characteristics test was conducted using color printer HP Color LaserJet 4650dn, manufactured by Hewlet-Packard Co. (cleaning-blade counter contact type).

The photoreceptor drum produced and a toner were mounted in the process cartridge for cyan, and this cartridge was mounted on the printer. In an atmosphere having a temperature of 10° C. and a humidity of 15% (often referred to as LL atmosphere), image formation on 10,000 sheets was conducted to evaluate the photoreceptor drum with respect to ghost images, fogging, decrease in density, filming (often abbreviated to FL), cleaning failure (often abbreviated to CL), and film loss. The results thereof are shown in Table 8.

[Test for Determining Unsusceptibility to Film Loss]

The film thickness of the initial photoreceptor drum was measured with film thickness meter Fisher Scope, and the film thickness thereof after the 10,000-sheet printing was measured also with film thickness meter Fisher Scope. The difference therebetween was calculated to thereby determine the film loss per 1,000 sheets.

[Evaluation of Others]

With respect to cleaning failure (CL), filming (FL), and image quality, the results were ranked as shown below. Incidentally, fogging was visually evaluated.

Item "Cleaning Failure"

A: No cleaning failure occurred at all.

B: Occurrence of slight cleaning failure can be ascertained, but the photoreceptor is on a practically usable level.

C: Occurrence of cleaning failure can be ascertained, but the photoreceptor is on a practically usable level.

D: Cleaning failure occurred over the entire surface, and the photoreceptor is on a practically problematic level.

Item "Filming"

A: No filming occurred at all.

B: Occurrence of slight filming can be ascertained, but the photoreceptor is on a practically usable level.

C: Occurrence of filming can be ascertained, but the photoreceptor is on a practically usable level.

D: Filming occurred over the entire surface, and the photoreceptor is on a practically problematic level.

Item "Image Quality"

A: No image abnormality is observed at all, and the photoreceptor is satisfactory.

B: Ghost images, density failures in LL atmosphere, background soils, or the like is slightly observed, but the photoreceptor practically is not problematic and is satisfactory.

C: Ghost images, density failures in LL atmosphere, background soils, or the like is observed, but the photoreceptor is on a practically usable level.

D: Ghost images, density failures in LL atmosphere, background soils, or the like is clear, and the photoreceptor is practically problematic.

Example A-21

Polyarylate C (PAR-C) was used in place of the polyarylate A (PAR-A) used in the coating fluid for charge transport layer formation used in Example A-20. Namely, a photoreceptor drum DE2 was obtained in the same manner as in Example A-20, except that the coating fluid for charge transport layer formation used in Example A-3 was used.

Comparative Example A-18

Polyamide resin XIII was used in place of the polyamide resin I used in the coating fluid for undercoat layer formation used in Example A-21. Namely, a photoreceptor drum DP1 was obtained in the same manner as in Example A-21, except that the coating fluid for undercoat layer formation used in Comparative Example A-9 was used.

Example A-22

A photoreceptor drum DP2 was obtained in the same manner as in Example A-20, except that use was made of a coating fluid for charge transport layer formation in which polycarbonate D (PCR-D) was used in place of the polyarylate A (PAR-A) used in the coating fluid for charge transport layer formation used in Example A-20.

TABLE 8

| | Photoreceptor drum | Film loss (μm/K) | CL | FL | Image quality |
|---|---|---|---|---|---|
| Example A-20 | DE1 | 0.12 | A | A | B |
| Example A-21 | DE2 | 0.09 | A | A | B |
| Comparative Example A-18 | DP1 | 0.06 | A | A | C |
| Example A-22 | DE3 | 0.60 | C | C | B |

It was ascertained from the results given in Table 8 that the photoreceptor drum DP1, which had an undercoat layer containing a polyamide resin outside the configuration of the invention, showed a deterioration in image quality due to a decrease in density. This is thought to be attributable to impaired electrical properties due to a deterioration in adhesion.

Example A-23

A photoreceptor drum DE4 was produced in the same manner as in Example A-20, except that an aluminum cylinder in which the surface had been mirror-polished and which had an outer diameter of 30 mm, length of 376 mm, and wall thickness of 0.75 mm was used in place of the aluminum cylinder used in Example A-20.

Example A-24

A photoreceptor drum DE5 was produced in the same manner as in Example A-23, except that use was made of a coating fluid for charge transport layer formation in which polycarbonate D (PCR-D) was used in place of the polyarylate A (PAR-A) used in the coating fluid for charge transport layer formation used in Example A-23.

Comparative Example A-19

Polyamide resin XIII was used in place of the polyamide resin I used in the coating fluid for undercoat layer formation used in Example A-23. Namely, a photoreceptor drum DP2 was produced in the same manner as in Example A-23, except that the coating fluid for undercoat layer formation used in Comparative Example A-13 was used.

The photoreceptor drums DE4, DE5, and DP2 produced here were each mounted in a black drum cartridge for color printer MICROLINE Pro 9800PS-E, manufactured by Oki Data Corp. Next, a toner for development (volume-average particle diameter, 7.05 μm; Dv/Dn=1.14; average degree of circularity, 0.963) produced in accordance with the Process for Producing Toner A for Development (emulsion polymerization aggregation method) described in JP-A-2007-213050 was mounted in a black toner cartridge. The drum cartridge and the toner cartridge were mounted on the printer.

(Specifications of MICROLINE Pro 9800PS-E)

Four-cartridge tandem

Color, 36 ppm; monochromatic, 40 ppm 1,200 dpi

Contact roller charging (DC voltage application)

LED exposure

With erase light

Under the conditions of a temperature of 25° C. and a humidity of 50%, a text document having a coverage rate of about 5% was printed, as image formation, on 30,000 sheets. The results of the image characteristics test conducted with this image formation are shown in Table 9.

TABLE 9

| | Photo-drum | Evaluation of initial image | Evaluation of image after 30,000-sheet printing | Remarks |
|---|---|---|---|---|
| Example A-23 | DE4 | good | good | — |
| Example A-24 | DE5 | good | decrease in density | — |

TABLE 9-continued

| | Photo-drum | Evaluation of initial image | Evaluation of image after 30,000-sheet printing | Remarks |
|---|---|---|---|---|
| Comparative Example A-19 | DP2 | good | soils in edge parts | slight film peeling at ends |

As shown in Table 9, the electrophotographic photoreceptor DE4 of Example A-23, which had the configuration of the invention, showed satisfactory image characteristics even after the 30,000-sheet printing. However, the photoreceptor drum DP2 of Comparative Example A-19 suffered slight film peeling at the ends of the drum, and soils due to the film peeling were observed at edge parts of the images; the photoreceptor drum DP2 thus gave practically problematic results.

Reference Example 1

Measurement of Universal Hardness of Undercoat Layer

The photoreceptor drum DE1 obtained in Example A-20 was immersed in a tetrahydrofuran solution to remove the photosensitive layer so that the undercoat layer became an outermost layer. This drum was dried at 125° C. for 20 minutes and then examined on the basis of (Conditions for examining Undercoat Layer) shown hereinabove under <Degree of Elastic Deformation and Universal Hardness>. Thus, a value of universal hardness was obtained. The results are shown in Table 10.

Reference Example 2

A photoreceptor drum DP3 was produced in the same manner as in Example A-20, except that polyamide resin V was used in place of the polyamide resin I used in the dispersion for undercoat layer formation of Example A-20. The photoreceptor drum DP3 was examined for universal hardness in the same manner as in Reference Example 1. The results thereof are shown in Table 10.

Reference Example 3

A photoreceptor drum DP4 was produced in the same manner as in Example A-20, except that polyamide resin VII was used in place of the polyamide resin I used in the dispersion for undercoat layer formation of Example A-20. The photoreceptor drum DP4 was examined for universal hardness in the same manner as in Reference Example 1. The results thereof are shown in Table 10.

Reference Example 4

A photoreceptor drum DP5 was produced in the same manner as in Example A-20, except that polyamide resin IX was used in place of the polyamide resin I used in the dispersion for undercoat layer formation of Example A-20. The photoreceptor drum DP5 was examined for universal hardness in the same manner as in Reference Example 1. The results thereof are shown in Table 10.

Reference Example 5

A photoreceptor drum DP6 was produced in the same manner as in Example A-20, except that polyamide resin X was used in place of the polyamide resin I used in the dispersion for undercoat layer formation of Example A-20. The photoreceptor drum DP6 was examined for universal hardness in the same manner as in Reference Example 1. The results thereof are shown in Table 10.

Reference Example 6

The photoreceptor drum DP1 obtained in Comparative Example A-18 was examined for universal hardness in the same manner as in Reference Example 1. The results thereof are shown in Table 10.

TABLE 10

| | Photoreceptor drum | Universal hardness of undercoat layer ($N/mm^2$) |
|---|---|---|
| Reference Example 1 | DE1 | 19.1 |
| Reference Example 2 | DP3 | 49.2 |
| Reference Example 3 | DP4 | 166.4 |
| Reference Example 4 | DP5 | 90.6 |
| Reference Example 5 | DP6 | 57.2 |
| Reference Example 6 | DP2 | 363.6 |

It can be seen from the results given in Table 3 to Table 9 that the inclusion of the polyamide resins according to the invention enables the photoreceptors to show satisfactory adhesion. It can also be seen that the photoreceptors simultaneously show satisfactory electrical properties stably. Furthermore, these photoreceptors gave satisfactory results also with respect to image characteristics.

While the invention has been described in detail and with reference to specific embodiments thereof, it will be apparent to one skilled in the art that various changes and modifications can be made therein without departing from the spirit and scope thereof.

This application is based on a Japanese patent application filed on Jun. 20, 2012 (Application No. 2012-138967), a Japanese patent application filed on Jul. 2, 2012 (Application No. 2012-148568), a Japanese patent application filed on Jul. 31, 2012 (Application No. 2012-170116), and a Japanese patent application filed on Mar. 22, 2013 (Application No. 2013-060367), the contents thereof being incorporated herein by reference.

DESCRIPTION OF THE REFERENCE NUMERALS AND SIGNS

1 Drum-shaped photoreceptor
2 Charging means
3 Exposure part
4 Developing means
5 Corona transfer means
6 Cleaning means
7 Fixing means
41 Developing vessel
42 Agitator
43 Feed roller
44 Developing roller
45 Control member
71 Upper fixing member (fixing roller)
72 Lower fixing member (fixing roller)
73 Heater
T Toner
P Receiving object

The invention claimed is:

1. An electrophotographic photoreceptor, comprising:

a conductive support; and, provided thereon, at least an undercoat layer and a photosensitive layer, wherein the undercoat layer comprises a binder resin and wherein the binder resin comprises a polyamide resin having a degree of elastic deformation, as determined on the basis of the following measuring method, of 56.0% or higher:

[Measuring method] The polyamide resin is molded into a film having a thickness of 10 μm or larger, and examined with a Vickers indenter in an atmosphere having a temperature of 25° C. and a relative humidity of 50% under the conditions of a maximum indentation load of 5 mN, a load-increasing period of 10 seconds and a load-removing period of 10 seconds to obtain a maximum indentation depth, and the value at the maximum indentation depth is taken as the degree of elastic deformation.

2. The electrophotographic photoreceptor according to claim 1, wherein the polyamide resin comprises a polyether structure.

3. The electrophotographic photoreceptor according to claim 1, wherein the content of the polyamide resin is 25 parts by mass or higher per 100 parts by mass of the binder resin.

4. The electrophotographic photoreceptor according to claim 1, wherein the photosensitive layer contains a polyarylate resin.

5. An electrophotographic photoreceptor cartridge, comprising:

the electrophotographic photoreceptor according to claim 1; and at least one part selected from the group consisting of a charging part for charging the electrophotographic photoreceptor, an exposure part for exposing the charged electrophotographic photoreceptor to form an electrostatic latent image, a development part for developing the electrostatic latent image formed on the electrophotographic photoreceptor, and a cleaning part for cleaning the surface of the electrophotographic photoreceptor.

6. An image forming apparatus, comprising:

the electrophotographic photoreceptor according to claim 1;

a charging part for charging the electrophotographic photoreceptor;

an exposure part for exposing the charged electrophotographic photoreceptor to form an electrostatic latent image;

a development part for developing the electrostatic latent image formed on the electrophotographic photoreceptor; and a cleaning part for cleaning the surface of the electrophotographic photoreceptor.

7. An electrophotographic photoreceptor comprising:

a conductive support; and, provided thereon, at least an undercoat layer and a photosensitive layer, which have been laminated in this order from the conductive-support side, wherein the undercoat layer comprises a polyamide resin comprising:

at least one of a linear dicarboxylic acid component and a branched dicarboxylic acid component;

at least one of a lactam component and an aminocarboxylic acid component; and polytetramethylene ether glycol as a polyether component.

8. The electrophotographic photoreceptor according to claim 7, wherein the polyamide resin is a block copolymerized polyamide resin comprising: a polyamide block which comprises the at least one of a linear dicarboxylic acid component and branched dicarboxylic acid component and the at least one of a lactam component and aminocarboxylic acid component; and a polyether block which comprises the polyether component.

9. The electrophotographic photoreceptor according to claim 8, wherein the block copolymerized polyamide resin has formula [1]:

$$-[HS\text{-}SS]_n- \quad [1]$$

HS represents a hard segment, which is a polymer unit comprising at least one kind of polyamide block that comprises at least one of a lactam component and an aminocarboxylic acid component and at least one of a linear dicarboxylic acid component and a branched dicarboxylic acid component; and SS represents a soft segment, which is a polymer unit comprising a polyether block that comprises at least one kind of polyether component.

10. The electrophotographic photoreceptor according to claim 9, wherein the HS and SS in the block copolymerized polyamide resin represented by formula [1] are bonded to each other by an ester bond.

11. The electrophotographic photoreceptor according to claim 8, wherein the polyether block includes polytetramethylene ether glycol or polypropylene ether glycol.

12. The electrophotographic photoreceptor according to claim 8, wherein the content of the polyether block in the undercoat layer is 4% by mass or higher.

13. The electrophotographic photoreceptor according to claim 8, wherein the polyamide block is obtained by polymerizing at least one of a lactam having a single structure and an aminocarboxylic acid having a single structure.

14. The electrophotographic photoreceptor according to claim 8, wherein the block copolymerized polyamide resin contains no dimer acid component.

15. The electrophotographic photoreceptor according to claim 8, wherein the block copolymerized polyamide resin contains no diamine component.

16. An electrophotographic photoreceptor comprising:

a conductive support; and, provided thereon, at least an undercoat layer and a photosensitive layer, which have been laminated in this order from the conductive-support side, wherein the undercoat layer comprises a polyamide resin comprising:

at least one of a linear dicarboxylic acid component and a branched dicarboxylic acid component;

at least one of a lactam component and an aminocarboxylic acid component; and a polyether component, and wherein the polyamide resin has an ester bond.

17. The electrophotographic photoreceptor according to claim 16, wherein the polyamide resin is a block copolymerized polyamide resin comprising: a polyamide block which comprises the at least one of a linear dicarboxylic acid component and branched dicarboxylic acid component and the at least one of a lactam component and aminocarboxylic acid component; and a polyether block which comprises the polyether component.

18. The electrophotographic photoreceptor according to claim 17, wherein the block copolymerized polyamide resin has formula [1]:

$$-[HS\text{-}SS]_n- \quad [1]$$

wherein:

HS represents a hard segment, which is a polymer unit comprising at least one kind of polyamide block that comprises at least one of a lactam component and an aminocarboxylic acid component and at least one of a linear dicarboxylic acid component and a branched dicarboxylic acid component; and SS represents a soft segment, which is a polymer unit comprising a polyether block that comprises at least one kind of polyether component.

19. The electrophotographic photoreceptor according to claim 18, wherein the HS and SS in the block copolymerized polyamide resin represented by formula [1] are bonded to each other by an ester bond.

20. The electrophotographic photoreceptor according to claim 17, wherein the polyether block includes polytetramethylene ether glycol or polypropylene ether glycol.

21. The electrophotographic photoreceptor according to claim 17, wherein the content of the polyether block in the undercoat layer is 4% by mass or higher.

22. The electrophotographic photoreceptor according to claim 17, wherein the polyamide block is obtained by polymerizing at least one of a lactam having a single structure and an aminocarboxylic acid having a single structure.

23. The electrophotographic photoreceptor according to claim 17, wherein the block copolymerized polyamide resin contains no dimer acid component.

24. The electrophotographic photoreceptor according to claim 17, wherein the block copolymerized polyamide resin contains no diamine component.

* * * * *